US006361354B1

(12) United States Patent
Viklund et al.

(10) Patent No.: US 6,361,354 B1
(45) Date of Patent: Mar. 26, 2002

(54) VERTICAL AND RIGHT ANGLE MODULAR OUTLETS

(75) Inventors: Mark Viklund, New Milford; Dean Stoddart, Ridgefield, both of CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 09/499,509

(22) Filed: Feb. 7, 2000

Related U.S. Application Data

(63) Continuation-in-part of application No. 09/273,241, filed on Mar. 19, 1999, which is a continuation-in-part of application No. 09/110,521, filed on Jul. 6, 1998, now Pat. No. 6,083,052, which is a continuation-in-part of application No. 09/046,396, filed on Mar. 23, 1998.

(51) Int. Cl.[7] ..... H01R 4/24
(52) U.S. Cl. ..... 439/418; 439/676
(58) Field of Search ..... 439/676, 418

(56) References Cited

U.S. PATENT DOCUMENTS

| | | | | | |
|---|---|---|---|---|---|
| 4,292,736 | A | | 10/1981 | Hughes et al. | 439/676 |
| 4,699,595 | A | | 10/1987 | Nakazawa et al. | 439/676 |
| 5,118,311 | A | * | 6/1992 | Margini | 439/344 |
| 5,387,135 | A | * | 2/1995 | Shen et al. | 439/676 |
| 5,456,619 | A | * | 10/1995 | Belopolsky et al. | 439/676 |
| 5,599,209 | A | * | 2/1997 | Belopolsky | 439/676 |
| 5,639,266 | A | * | 6/1997 | Patel | 439/676 |
| 5,687,478 | A | | 11/1997 | Belopolsky | 439/676 |
| 5,697,817 | A | | 12/1997 | Bouchan et al. | 439/676 |
| 5,779,503 | A | | 7/1998 | Tremblay et al. | 439/676 |
| 5,791,942 | A | | 8/1998 | Patel | 439/637 |
| 6,012,953 | A | | 1/2000 | Francis | 439/676 |
| 6,086,428 | A | | 7/2000 | Pharney et al. | 439/676 |

FOREIGN PATENT DOCUMENTS

| | | | |
|---|---|---|---|
| EP | 0 952 640 A1 | 10/1999 | 439/676 |

* cited by examiner

*Primary Examiner*—Renee Luebke
*Assistant Examiner*—Briggitte R. Hammond
(74) *Attorney, Agent, or Firm*—Cantor Colburn LLP

(57) ABSTRACT

One embodiment of the invention is a ninety degree modular outlet having reduced crosstalk. Reduced crosstalk is achieved in part by selecting the position of contacts within the outlet housing. A second embodiment of the invention is a vertical modular outlet having reduced crosstalk. Reduced crosstalk is achieved in part by positioning contact termination ends of the contacts to reduce interference.

13 Claims, 34 Drawing Sheets

VERTICAL AND RIGHT ANGLE MODULAR OUTLETS

CROSS REFERENCE TO RELATED APPLICATIONS

This application is a continuation-in-part of U.S. patent application Ser. No. 09/273,241 filed Mar. 19, 1999, the entire contents of which are incorporated by reference herein, which is a continuation-in-part of U.S. patent application Ser. No. 09/110,521 filed Jul. 6, 1998, the entire contents of which are incorporated by reference herein, which is a continuation-in-part of U.S. patent application Ser. No. 09/046,396 filed Mar. 23, 1998, the entire contents of which are incorporated by reference herein.

FIELD OF THE INVENTION

The invention relates generally to an enhanced performance connector and in particular, to a connector including a plug, outlet and connecting block each of which is designed for enhanced performance.

BACKGROUND OF THE INVENTION

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. New standards are being developed continuously and currently it is expected that future standards will require transmission requirements of at least 600 MHZ.

The above referenced transmission requirements also specify limits on near-end crosstalk (NEXT). Often, telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art.

Existing telecommunications products include plugs, outlets and connecting blocks. Each of these devices can suffer from crosstalk as the rate of transmission increases. To reduce this crosstalk, modular plugs have been developed utilizing several different approaches. Prior art plugs, such as those sold by Hubbell, AT&T, and Thomas & Betts use square wire contacts to reduce contact overlap. Other prior art plugs, such as those sold by Amp and RJ Enterprises use an inline load bar. Other prior art plugs, such as those sold by Stewart and Sentinel use a loadbar with a staggered, non-coplanar scheme.

Outlets have also been designed to reduce crosstalk as the rate of transmission increases. To reduce this crosstalk modular outlets have been developed utilizing resilient conductive pins with two resilient conductive pins entering the plug mating area from the rear as opposed to the usual front. Prior art devices such as that sold by Stewart have conductive pins 3 and 6 entering the plug mating area from the rear.

Connecting blocks have also been designed to reduce crosstalk. Current 110 type connecting systems are designed to support digital data transmission as well as analog/digital voice over unshielded twisted pair (UTP) media through the use of wiring blocks, connecting blocks and patch cords or jumpers. This system facilitates moves and rearrangements of circuits connected to end-users or equipment. These 110 type blocks use punch down insulation displacement contacts (IDC) to maximize density and ease of use. A limitation of prior art devices is the difficulty encountered when lacing and punching down twisted pair wiring. The tips of the 110 type blocks between the IDC pairs are typically blunt and require untwisting of the wire prior to lacing into the block. This could lead to excessive untwist in the pair and a loss of electrical performance.

While there exist plugs, outlets and connecting blocks designed to reduce crosstalk and enhance performance, it is understood in the art that improved plugs, outlets and connecting blocks are needed to meet increasing transmission rates.

SUMMARY OF THE INVENTION

The above-discussed and other drawbacks and deficiencies of the prior art are overcome or alleviated by the modular outlets of the present invention. One embodiment of the invention is a ninety degree modular outlet having reduced crosstalk. Reduced crosstalk is achieved in part by selecting the position of contacts within the outlet housing. A second embodiment of the invention is a vertical modular outlet having reduced crosstalk. Reduced crosstalk is achieved in part by positioning contact termination ends of the contacts to reduce interference.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGS..

DESCRIPTION OF PREFERRED EMBODIMENTS

Figure 1:
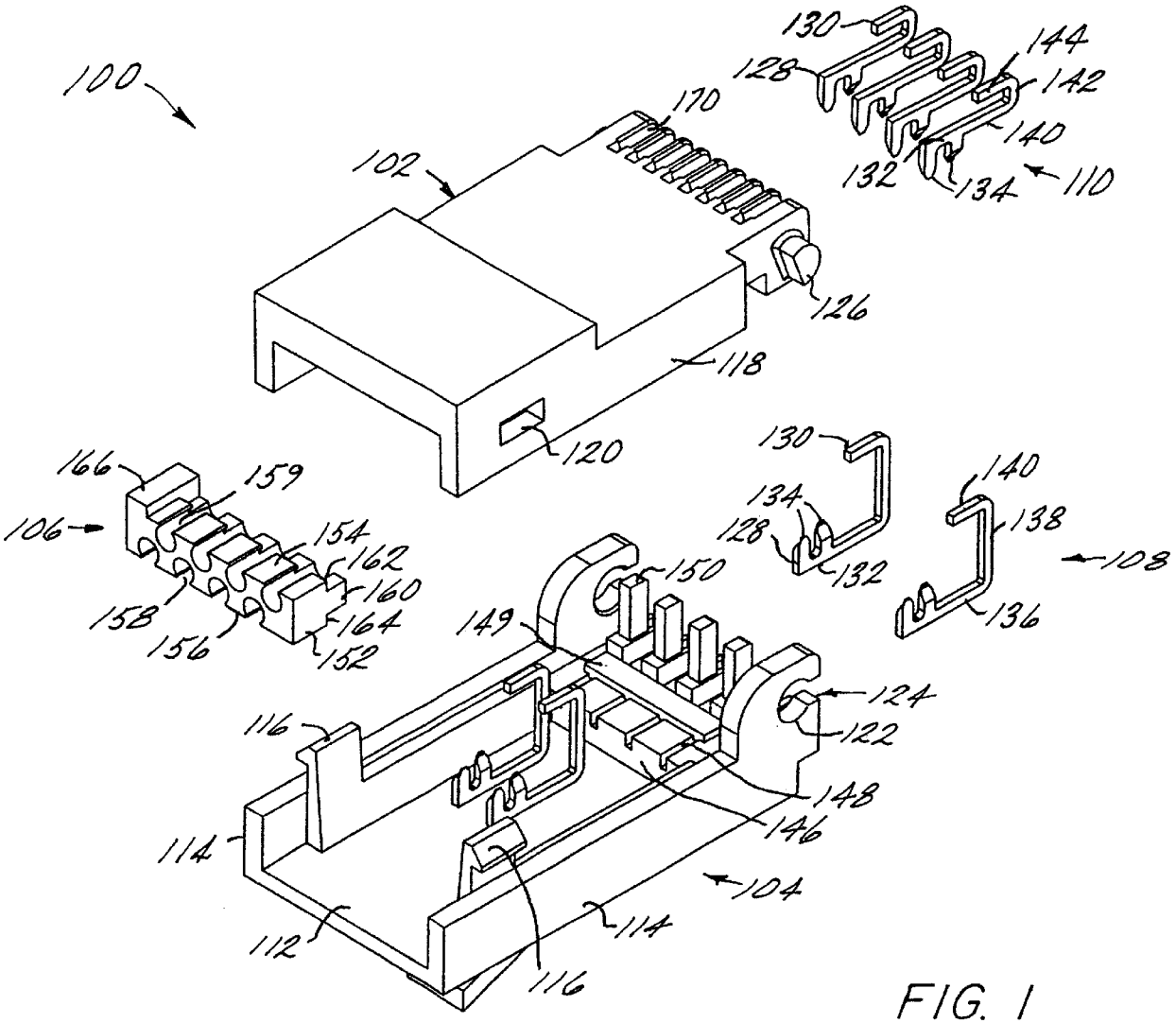
FIG. 1 is an exploded, perspective view of a plug in accordance with the present invention.

FIG. 1 is an exploded view of an enhanced performance plug, shown generally at 100, in accordance with an exemplary embodiment of the invention. The plug 100 is designed to mate with RJ-45 outlets and includes a top housing 102 that engages a bottom housing 104. Top and bottom housings are preferably made from resilient plastic but may also be shielded as is known in the art. Contacts 110 are mounted in the top housing 102 and contacts 108 are mounted in the bottom housing 104. A load bar 106 receives wires and serves to position the wires in the proper location for termination on the contacts 108 and 110.

Bottom housing 104 includes a planar base 112 and a pair of side walls 114. Extending beyond side walls 114 are two latches 116. Top housing 102 includes side walls 118 having openings 120 for receiving latches 116. Top housing 102 includes a series of spaced, isolated slots 170 that receive the distal ends 130 of contacts 108 and contacts 110. Side wall 114 also includes a circular opening 122 having a neck 124. Neck 124 has an inner dimension less than the diameter of circular opening 122. The circular opening 122 receives a hinge pin 126 formed on the top housing 102. The hinge pin 126 is a portion of a cylinder having a circular surface and a planar surface. The hinge pin 126 has a minimum width in one direction that allows the hinge pin 126 to pass through neck 124. The hinge pin 126 can only pass through neck 124 when the top housing 102 is in an open position. Upon rotation of the top housing 102 relative to the bottom housing 104, the hinge pin minimum width is no longer aligned with neck 124 and hinge pin 126 is secured in circular opening 122.

Contacts 108 and 110 each includes an insulation displacement contact (IDC) end 128 and a distal end 130. The IDC end includes a base 132 and IDC arms 134 pointing away from the base in a first direction. Referring to contact 108, extending away from IDC end 128, perpendicular to the first direction, is leg 136 which is bent approximately 90 degrees to point in the first direction to define leg 138. Leg 138 is bent approximately 90 degrees to define leg 140 which is perpendicular to the first direction.

Figure 1A:
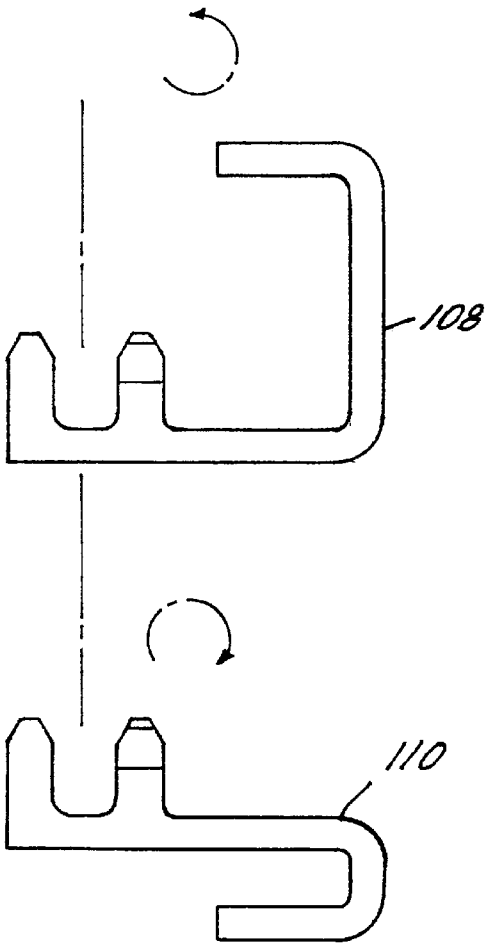
FIG. 1A is a side view of the contacts used in the plug.

Contact 110 similarly includes an IDC end 128 having IDC arms 134 extending away from a base 132 in a first direction. Leg 140 extends away from the IDC end 128 perpendicular to the first direction and is bent approximately 90 degrees to point opposite the first direction to define leg 142. Leg 142 is bent approximately 90 degrees to form leg 144 which is perpendicular to the first direction. Contact 110 differs from contact 108 in the direction of the bends with respect to the first direction. As shown in FIG. 1A, if the IDC arms 134 point in a first direction to define a reference axis, contacts 108 are bent in a counterclockwise direction and contacts 110 are bent in a clockwise direction relative to reference axis.

Bottom housing 104 includes a contact holder 146 having a plurality of channels 148 for receiving contacts 108. The contacts 108 are installed into channels 148 in a straight condition. Contacts 108 are then bent to form legs 136, 138 and 140 described above. A series of posts 150 are positioned above the channels 148 towards the exit end of each channel 148. The posts 150 help support the contacts 108 during the bending process and during the use of the plug 100. A lip 149 is provide on the top of the contact holder 146 and abuts against a bottom shoulder 164, to assist in positioning load bar 106 relative to bottom housing 104.

Load bar 106 is made from a generally rectangular block 152 having a top surface 154 and a bottom surface 156. Circular channels 159 are formed in the top surface 154 and circular channels 158 are formed in the bottom surface 156. The channels 158 in bottom surface 156 are equally spaced and offset from the channels 159, also equally spaced, in the top surface 154. The block 152 has a portion of reduced dimension (e.g. height) 160 forming a top shoulder 162 and a bottom shoulder 164 along the length of the load bar 106. Bottom shoulder 164 abuts against lip 149 to position the load bar 106 in the bottom housing 104. Side walls 114 also align the bottom channels 158 with channels 148 so that wires installed in the channels 158 are aligned with IDC ends 128 of contacts 108. Load bar 106 also includes an extension 166 that engages a recess 168 (FIG. 3) formed in the top housing 102. The plug 100 minimizes wire buckling through the use of load bar 106 which allows the wire to be terminated inside the load bar 106. Termination inside the load bar eliminates the possibility of the wires buckling, while pushing them through the load bar, and into the plug termination area.

Figure 2:
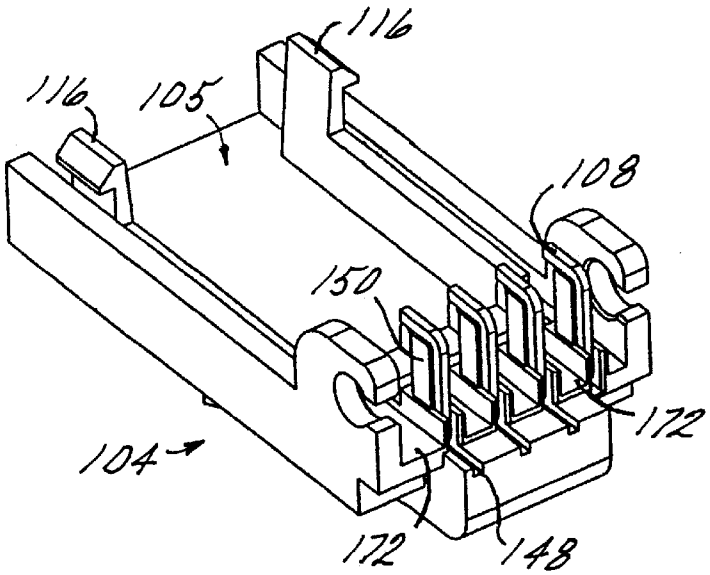
FIG. 2 is a perspective view of a bottom housing of the plug.

FIG. 2 is a perspective view of the bottom housing 104 with contacts 108 mounted therein. As shown in FIG. 2, posts 150 positioned above each channel 148 support both leg 138 and leg 140 of contacts 108. Posts 150 facilitate manufacturing by providing a surface for bending the contacts 108. Posts 150 also support the distal ends 130 of contacts 108 so that the distal ends 130 are not deflected upon mating the plug with an outlet. Recesses 172 are formed adjacent to channels 148 and provide room for the top housing 102 to rotate relative to bottom housing 104. Recesses 172 are three sided areas having a rear wall that seals the recess 172 from the interior 105 of the bottom housing 104.

Figure 3:
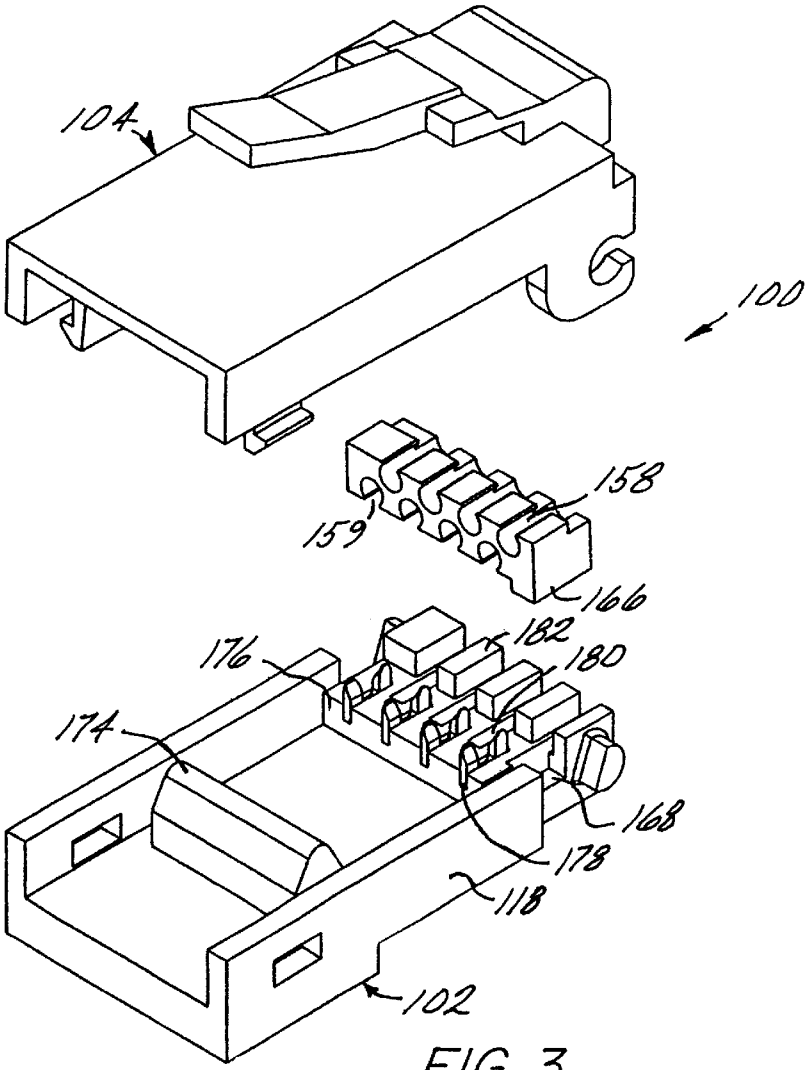
FIG. 3 is an exploded, perspective view of the plug.

FIG. 3 is an exploded perspective view of the plug 100 showing the interior of top housing 102. Top housing 102 includes a strain relief projection 174 that compresses the jacket of the incoming cable against bottom housing 104 and provides strain relief. Top housing 102 includes a contact holder 176 having a plurality of spaced channels 178 for receiving contacts 110. A plurality of openings 180 are provided on top housing 102 to allow contacts 108 to enter slots 170. A plurality of extensions 182 project away from contact holder 176 and are located to engage recesses 172 on bottom housing 104. Extensions 182 extend sufficiently into recesses 172 to prevent dust from entering the interior of plug 100 but not so deep so as to prevent rotation of top hosing 102 relative to bottom housing 104. Top housing 102 includes a recess 168 that receives extension 166 on loadbar 106. This positions loadbar 106 relative to top housing 102. Upon installation of the loadbar 106, channels 159 in loadbar 106 are aligned with channels 178 and the IDC end 128 of contacts 110.

Figure 4:
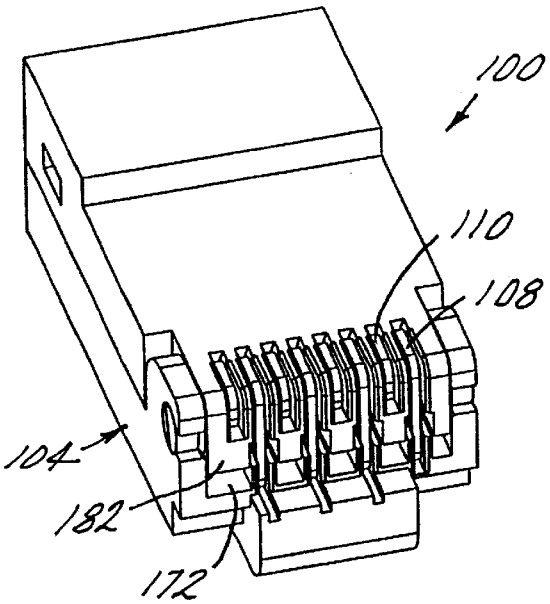
FIG. 4 is perspective view of the plug.

FIG. 4 is a perspective view of the assembled plug 100. To assemble the plug 100, wires are laced into the channels 158 and 159 and the load bar 106 is placed in either the top housing 102 or bottom housing 104. Hinge pins 126 are placed in circular openings 122 and the top housing 102 and bottom housing 104 are rotated towards one another. Channels 158 in load bar 106 are aligned with channels 148 in bottom housing 104 and channels 159 are aligned with channel 178 in top housing 102. As the top housing 102 is rotated towards the bottom housing, the IDC ends 128 of contacts 108 and 110 contact the wires in loadbar 106 piercing the insulation of each wire and establishing electrical contact between the wires and the contacts 108 and 110. Upon complete rotation, latches 116 engage openings 120 and the plug is assembled. Terminating the wires within the loadbar 106 creates a more simple final assembly because the wires do not have to be pushed through the loadbar, into the plug housing. As shown in FIG. 4, extensions 182 are positioned in recesses 172 to prevent dust and other contaminants from entering plug 100.

Contacts 108 and 110 are designed to reduce the amount of adjacent area between neighboring contacts. The distal ends of contacts 108 and 110 will be adjacent to each other in slots 170 and legs 144 and 140 will necessarily be adjacent to each other in order to mate with a standard RJ-45 outlet. The contacts 108 and 110 diverge away from each after exiting slots 170. Accordingly, there is minimal adjacent area between legs 142 and 138 and no adjacent area between legs 136 and 140. By reducing the adjacent area between neighboring contacts, crosstalk is reduced and performance is enhanced. In addition, the loadbar 106 helps improve performance. The loadbar spaces the wires in different planes (top channels 158 and bottom channels 159) which reduces the likelihood of crosstalk. In addition, the loadbar standardizes and minimizes the amount of untwist needed for each pair further reducing crosstalk. Along with reducing crosstalk, the plug of the present invention improves upon return loss and achieves better balance. This improved performance allows for data transmission at higher frequencies, with less noise from adjacent pairs.

Figure 5:
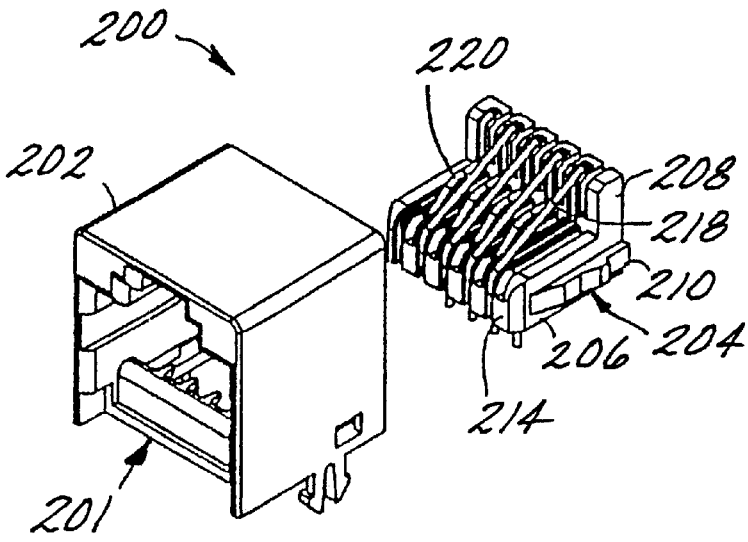
FIG. 5 is an exploded, perspective view of an outlet.
Figure 6:
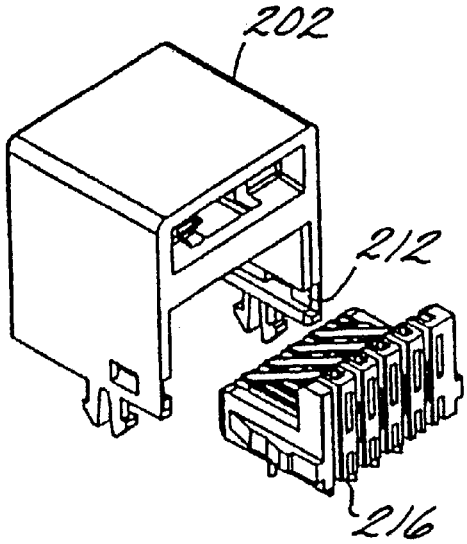
FIG. 6 is an exploded, perspective view of the outlet.

FIGS. 5 and 6 are exploded perspective views of a 90 degree version of an enhanced performance outlet shown generally at 200. The outlet 200 includes a housing 202 and a contact carrier 204 made from a resilient plastic. The outlet 200 could also be constructed as a shielded outlet as known in the art. Outlet 200 is referred to as 90 degree because opening 201 in housing 202 is in a plane perpendicular to the plane of the contact carrier 204 through which the termination ends of contacts 220 and 218 extend. The contact carrier is generally L-shaped and includes a base 206 and a rear wall 208 generally perpendicular to base 206. The contact carrier 204 has a front edge 214 disposed opposite a rear edge 216 where rear wall 208 joins base 206. Ribs 210 on the base 206 engage channels 212 formed in the side walls of the housing 202 to secure the contact carrier 204 to the housing 202. The outlet 200 includes two types of contacts 218 and 220 which have different shapes to reduce the amount of adjacent area between neighboring contacts and thus improve performance. The contacts 218 and 220 are made from gold plated or palladium nickel plated phosphor bronze wire. Contacts 218 and 220 alternate across the contact carrier 204.

Figure 7:
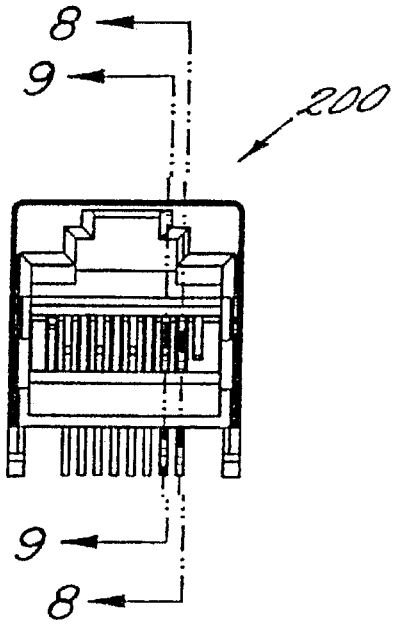
FIG. 7 is a front view of the outlet.
Figure 8:
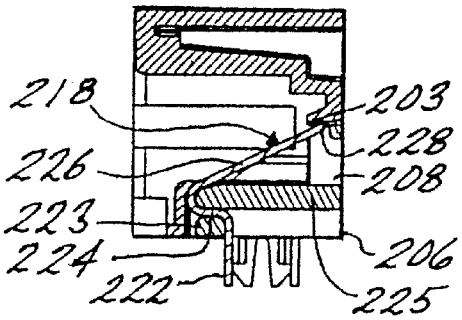
FIG. 8 is a cross-sectional view taken along line 8—8 of FIG. 7.

FIG. 7 is a front view of the outlet 200. FIG. 8 is a cross sectional view of the outlet 200 taken along line 8—8 of FIG. 7. FIG. 8 shows in detail a first contact 218. First contact 218 has a termination end 222 that engages a circuit board. From the termination end 222, contact 218 enters the bottom of contact carrier 204 and bends approximately 90 degrees to form leg 224. Contact 218 then bends more than 90 degrees but less than 180 degrees to define leg 226 that exits the contact carrier 204 proximate to front edge 214. The distal end 228 terminates within the rear wall 208 and is positioned below lip 203 formed on the inside of housing 202. The path for contact 218 is provided by a first channel formed through the contact carrier 204. The path is provided in part by a first member 223 positioned proximate to the bottom of base 206 and a second member 225 positioned proximate to the top of base 206. A gap is provided between first member 223 and second member 225 to receive leg 224.

Figure 9:
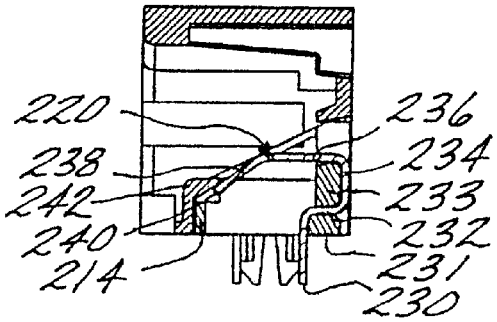
FIG. 9 is a cross-sectional view taken along line 9—9 of FIG. 7.
Figure 10:
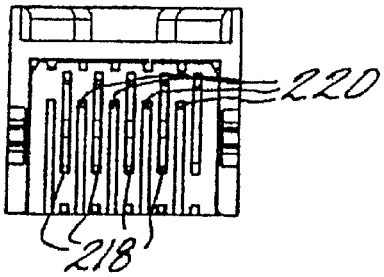
FIG. 10 is a bottom view of the outlet.

FIG. 9 is a cross-sectional view taken along line 9—9 of FIG. 7. Contact 220 alternates with contact 218 across contact carrier 204. Contact 220 has a distal end 230 extending from the bottom of contact carrier 204 for mounting in a circuit board as described below. Contact 220 is bent approximately 90 degrees to define leg 232 which is bent approximately 90 degrees to define leg 234. Leg 234 is bent approximately 90 degrees to define leg 236 which is bent less than 90 degrees to define leg 238. The distal end 240 of contact 220 is positioned under a rearwardly facing lip 242 formed on the housing 202 and positioned above the front edge 214 of contact carrier 204. As is clear from FIG. 9, contact 220 exits the contact carrier 204 at the rear wall 208 opposite front edge 214. The path for contact 220 is formed in part by third member 231 portioned proximate to the bottom of base 206 and fourth member 233 positioned at the junction between base 206 and rear wall 208. A gap is provided between third member 231 and fourth member 233 to receive leg 232. FIG. 10 is a bottom view of outlet 200. The outlet 200 also reduces crosstalk in the area where the contacts 218 and 220 mate with the circuit board by spacing the row of contacts 218 and row of contacts 220 further apart than standard modular jacks (typically 0.100 in).

The contacts 218 and 220 exiting the contact carrier from opposite ends is an important feature of the present invention. By alternating contacts 218 and 220 across the contact carrier, and having contacts 218 exit the contact carrier from one end and contacts 220 exit the contact carrier 204 from the opposite end, reduces the area where contacts 218 and 220 are adjacent. This reduction in adjacency enhances performance by reducing crosstalk, improves upon return loss and achieves better balance.

Figure 11:
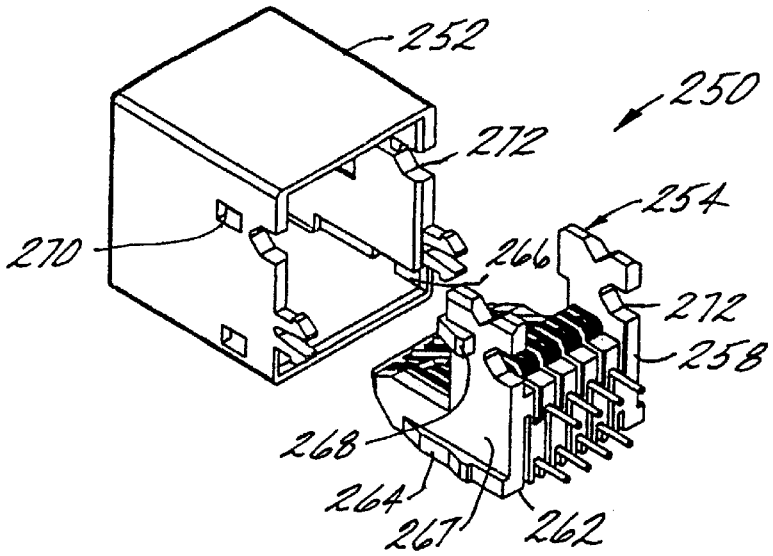
FIG. 11 is an exploded, perspective view of an alternative outlet.
Figure 12:
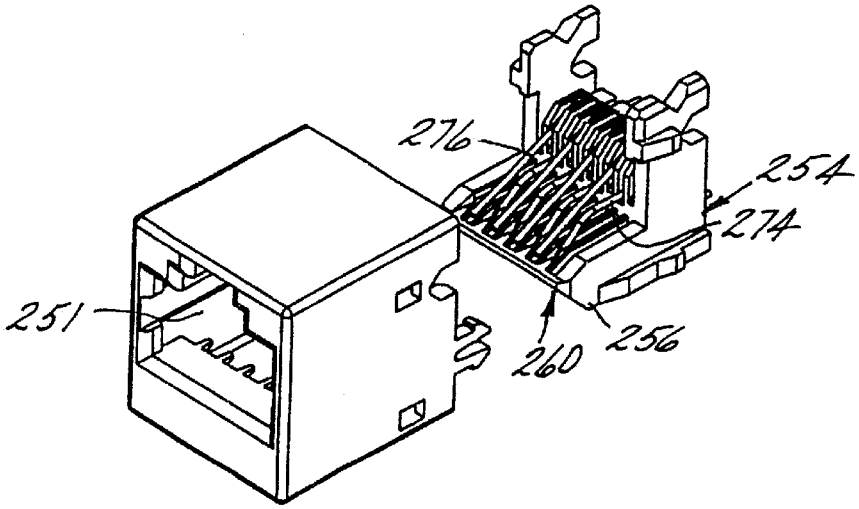
FIG. 12 is an exploded, perspective view of the alternative outlet.

FIGS. 11 and 12 are exploded perspective views of vertical version of an enhanced performance outlet shown generally at 250. The outlet 250 includes a housing 252 and a contact carrier 254 made from a resilient plastic. The outlet 250 could also be constructed as a shielded outlet as is known in the art. Outlet 250 is referred to as a vertical version because opening 251 in housing 252 is in a plane parallel to the plane of the contact carrier 254 through which the termination ends of contacts 274 and 276 extend. The contact carrier is generally L-shaped and includes a base 256 and a rear wall 258 generally perpendicular to base 256. The contact carrier 254 has a front edge 260 disposed opposite a rear edge 262 where rear wall 258 joins base 256. Ribs 264 on the base 256 engage channels 266 on the inside of housing 252 to secure the contact carrier 254 to the housing 252. A side wall 267 of contact carrier 254 includes protrusions 268 that engage openings 270 to secure the contact carrier 254 to the housing 252. Both housing 252 and rear wall 258 include recesses 272 that receive the tail of the contacts mounted in connecting block 300 described below. The outlet 250 includes two types of contacts 274 and 276 which have different shapes to reduce the amount of adjacent area between neighboring contacts and thus improve performance. The contacts 274 and 276 are made from gold plated or palladium nickel plated phosphor bronze wire. Contacts 274 and 276 alternate across the contact carrier 254.

Figure 13:
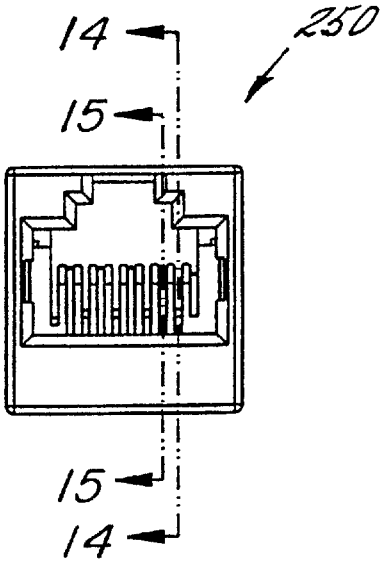
FIG. 13 is a front view of the alternative outlet.
Figure 14:
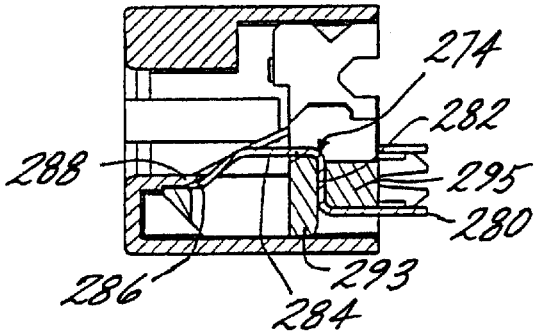
FIG. 14 is a cross-sectional view taken along line 14—14 of FIG. 13.

FIG. 13 is a front view of outlet 250. FIG. 14 is a cross sectional view of the outlet 250 taken along line 14—14 of FIG. 13. FIG. 14 shows in detail a first contact 274. First contact 274 has a termination end 280 that engages a circuit board. From the termination end 280, contact 274 enters the base 256 of contact carrier 254 and bends approximately 90 degrees to form leg 282. Contact 274 then bends approximately 90 degrees to define leg 284 that exits the rear wall 258 at a first height relative to the bottom of the base 256 and substantially perpendicular to rear wall 258. Contact 274 bends less than 90 degree and the distal end 286 terminates below rearwardly facing lip 288 formed on housing 252 and positioned above the front edge 260 of the contact carrier 254. The path for contact 274 is provided by a first channel formed through the contact carrier 254. The path is provided in part by a first member 293 and a second member 295 positioned proximate to the junction between the base 256 and the rear wall 258. A gap is provided between first member 293 and second member 295 to receive leg 282.

Figure 15:
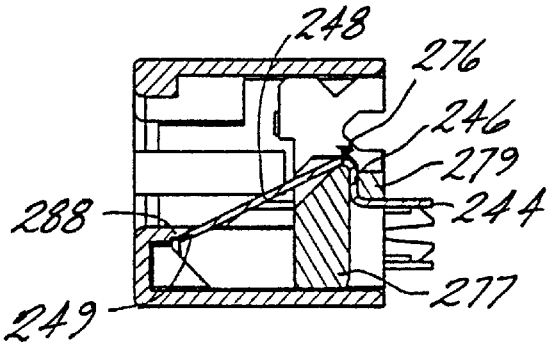
FIG. 15 is a cross-sectional view taken along line 15—15 of FIG. 13.
Figure 16:
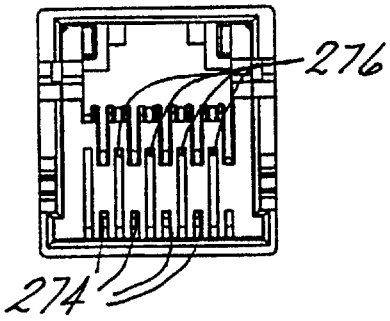
FIG. 16 is a bottom view of the alternative outlet.

FIG. 15 is a cross-sectional view taken along line 15—15 of FIG. 13. Contact 276 alternates with contact 274 across contact carrier 254. Contact 276 has a termination end 244 extending from the rear wall 258 for mounting in a circuit board as described below. Contact 276 is bent approximately 90 degrees to define leg 246 which is bent more than 90 degrees to define leg 248. Leg 248 exits the rear wall 258 at a second height relative to the bottom of the base 256 different than the exit height of first contact 274 and exits at an oblique angle relative to the rear wall 258. The distal end 249 of contact 276 is positioned under a rearwardly facing lip 288 formed on housing 252 and positioned above the front edge 260 of contact carrier 254. The path for contact 276 is formed in part by third member 277 and fourth member 279 positioned in rear wall 258. A gap is provided between third member 277 and fourth member 279 to receive leg 246. FIG. 16 is a bottom view of outlet 250. The outlet 250 also reduces crosstalk in the area where the contacts 274 and 276 mate with the circuit board by spacing the row of contacts 218 and row of contacts 220 further apart than standard modular jacks (typically 0.100 in).

The contacts 274 and 276 exiting the rear wall of the contact carrier at different heights and at different angles is an important feature of the present invention. By alternating contacts 274 and 276 across the contact carrier, and having contacts 274 and 276 exit the rear wall of the contact carrier at different heights and at different angles reduces the amount of adjacent area between neighboring contacts 274 and 276. This reduction enhances performance by reducing crosstalk, improving return loss and achieving better balance.

Figure 17:
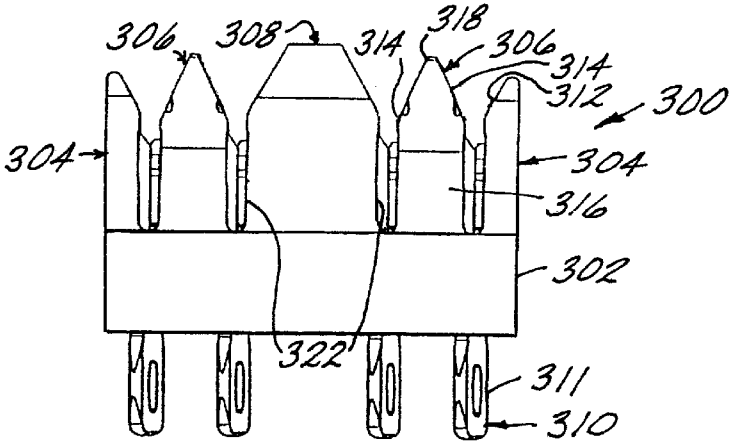

FIG. 17 is a side view of the connecting block 300 in accordance with an exemplary embodiment of the invention. Connecting block 300 includes a generally rectangular base 302 having end walls 304 extending upwards away from the base 302. Also extending away from base 302 are first teeth 306 and a second tooth 308. A gap 324 is provided between end wall 304 and first teeth 306 and first teeth 306 and second tooth 308. First teeth 306 separate insulation displacement contacts (IDC) 310 and second tooth 308 separates pairs of IDC's 310. IDC's 310 have press-fit tails 311 as described in U.S. Pat. No. 5,645,445. As is common in the art, a wire is placed in gap 324 and forced down on to the IDC 310 to create an electrical connection between the IDC 310 and the wire.

In accordance with an important aspect of the present invention, tooth 308 has a width along the longitudinal direction greater than the width of first tooth 306. Accordingly, the distance between IDC's in a pair is less than the distance between pairs. This staggered pair spacing reduces the likelihood of crosstalk between pairs and improves performance. The device of this invention further reduces the crosstalk between pairs by the use of a closer spacing of the IDC's within a pair. This closer spacing is achieved by positioning the IDC's in the block at an angle rather than in a parallel line. This closer spacing within a pair also allows for additional spacing between each pair, which also reduces the crosstalk. The IDC's 310 of this invention are also shorter in height and narrower in width than prior art devices, which further reduces the crosstalk.

End wall 304 has an inside surface 312 that tapers towards the outside of end wall 304. Similarly, first tooth 306 includes two inside surfaces 314 that taper towards each other and two outside surfaces 316 that taper toward each other to define point 318 at the distal end of first tooth 306. Tip 318 is narrow and has a width of less than 10/1000" and is preferably 5/1000". The tip 318 easily splits the twisted pair wiring without the need to untwist the wire pair prior to lacing and punching down. This improved tip 318 also improves termination of webbed twisted pair cables (each twisted pair is bonded together by a thin web of installation). This improved tip makes for quicker and easier punching down of the block. Another benefit of this invention is the distinct spacing between the pairs. This provides for easier visual identification of each pair during installation and servicing.

Figure 21:
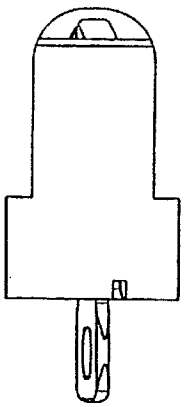
FIGS. 17–21 are views of a connecting block in accordance with the present invention.
Figure 18:
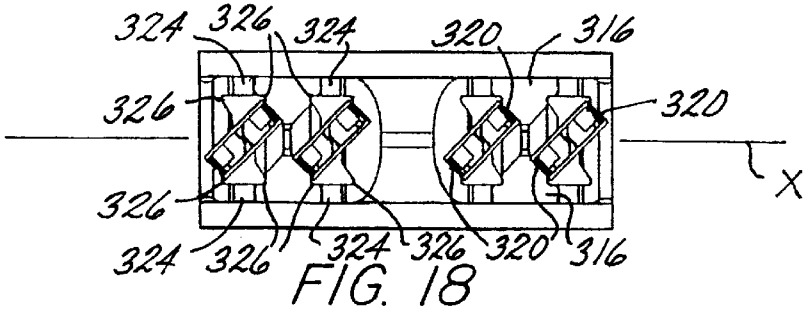
Figure 19:
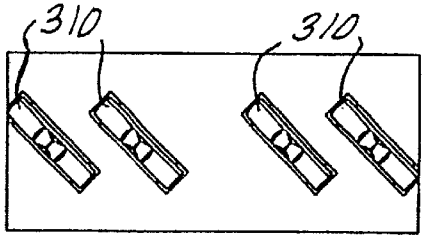
Figure 20:
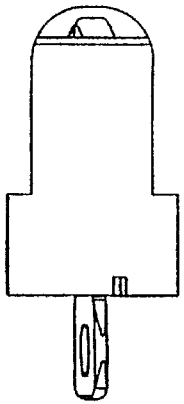
Figure 22:
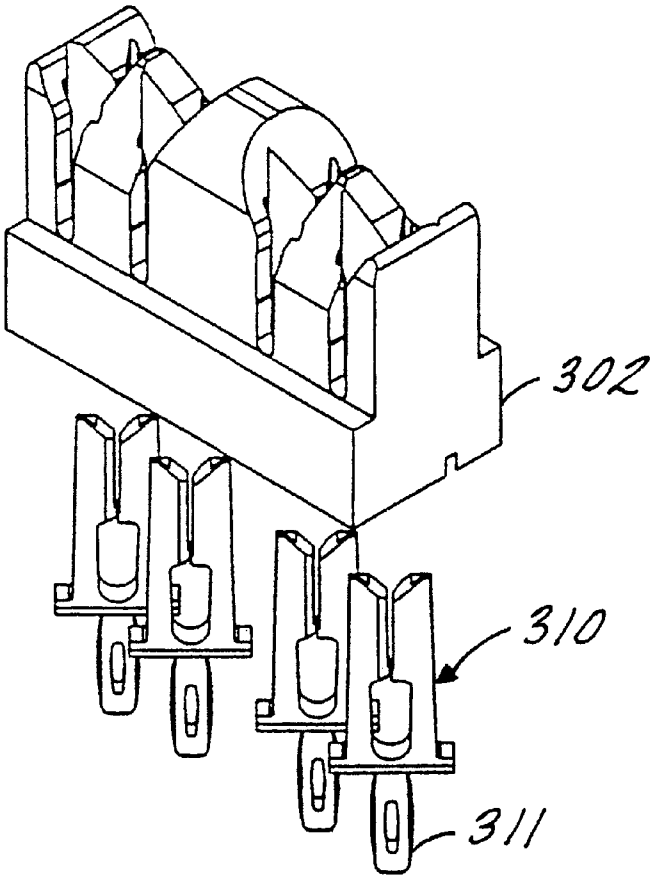
FIG. 22 is an exploded perspective view of the connecting block.

As shown in FIG. 18, inside surface 312 of end wall 304 and inside surface 314 of tooth 306 have a rectangular recess 320 formed therein which receive the edges of IDC 310. The IDC 310 is at an oblique angle relative to the longitudinal axis x of the connecting block 300. In an exemplary embodiment, the IDC 310 is at an angle of 45 degrees relative to the longitudinal axis of the connecting block. Inside surfaces 322 of tooth 308 similarly include a rectangular recess 320 for receiving an edge of the IDC 310. FIG. 19 is a bottom view of the connecting block 300 showing the IDC's 310 at a 45 degree angle relative to the longitudinal axis of the connecting block 300. FIGS. 20 and 21 are end views of the connecting block 300. FIG. 22 is an exploded perspective view of the connecting block showing IDC's 310. Although not shown in the drawings, a metallic barrier may be placed between the pairs to further reduce crosstalk.

Inside surface 312 of end wall 304 includes two notches 326. Similarly, inside surfaces 314 of tooth 306 each includes two notches 326 adjacent to gap 324 and inside surfaces 322 of tooth 308 each include two notches 326 adjacent to gap 324. The notches 326 reduce the amount of material contacting the wire in gap 324 and provide for more pressure per area than without notches 326. The increase in pressure per area more effectively secures wires in gaps 324.

Figure 24:
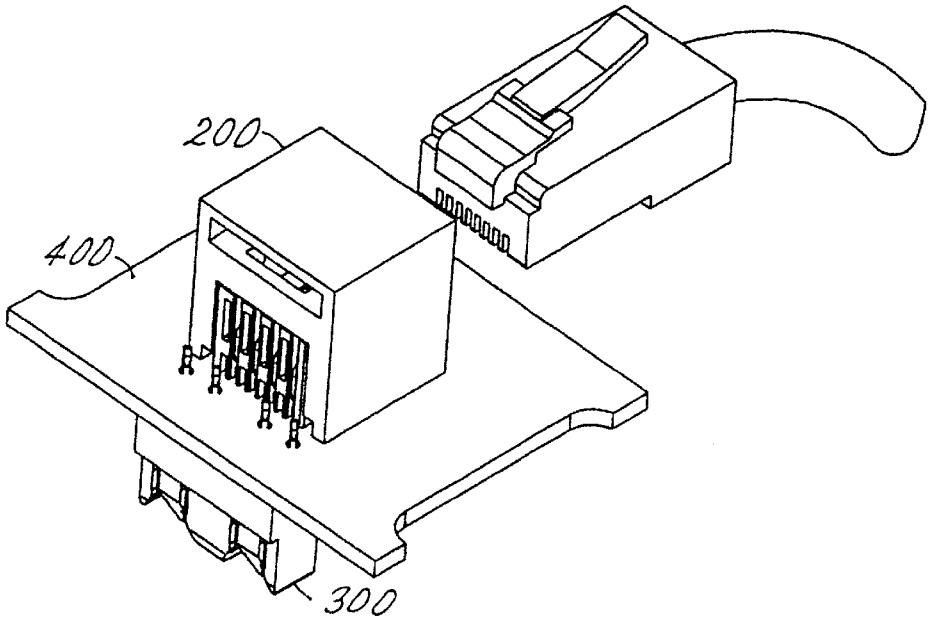
FIGS. 23 and 24 are perspective views of the connector.
Figure 23:
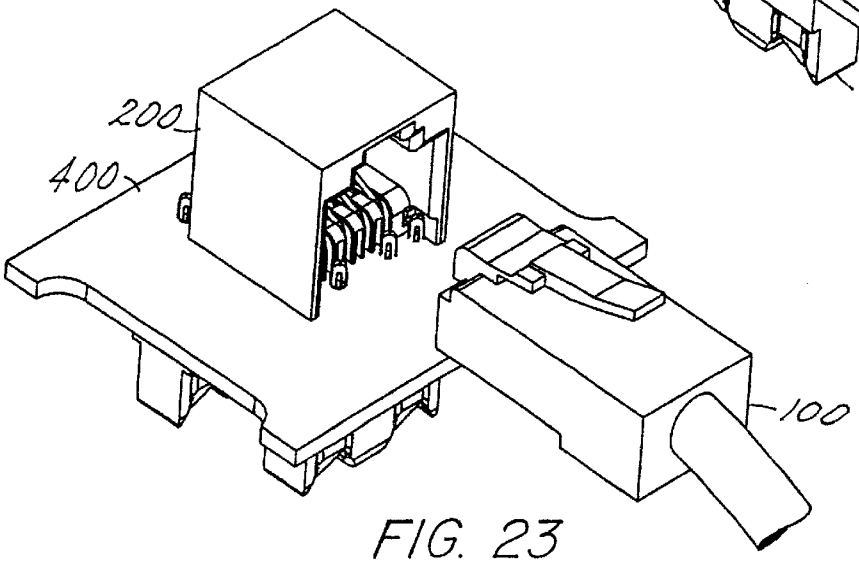
Figure 26:
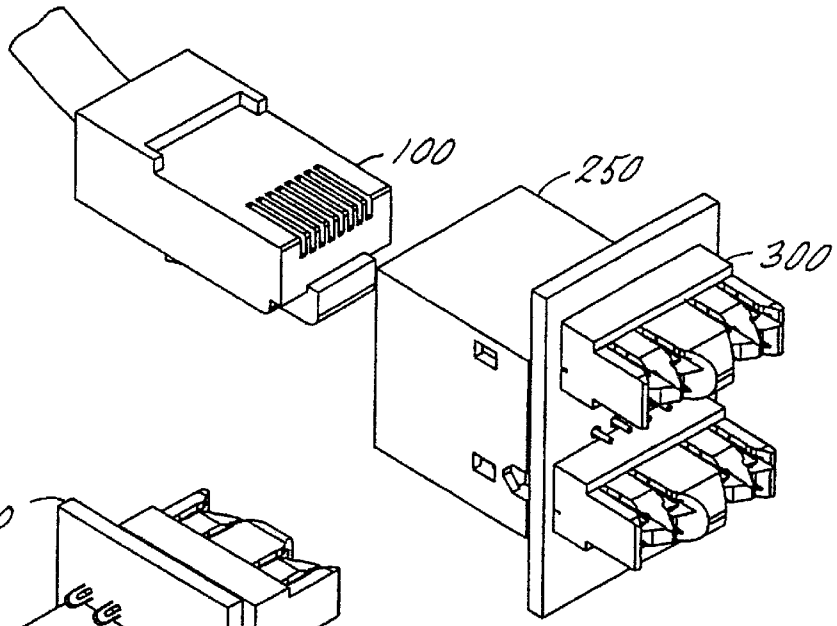
FIGS. 25 and 26 are perspective views of the alternative connector.
Figure 25:
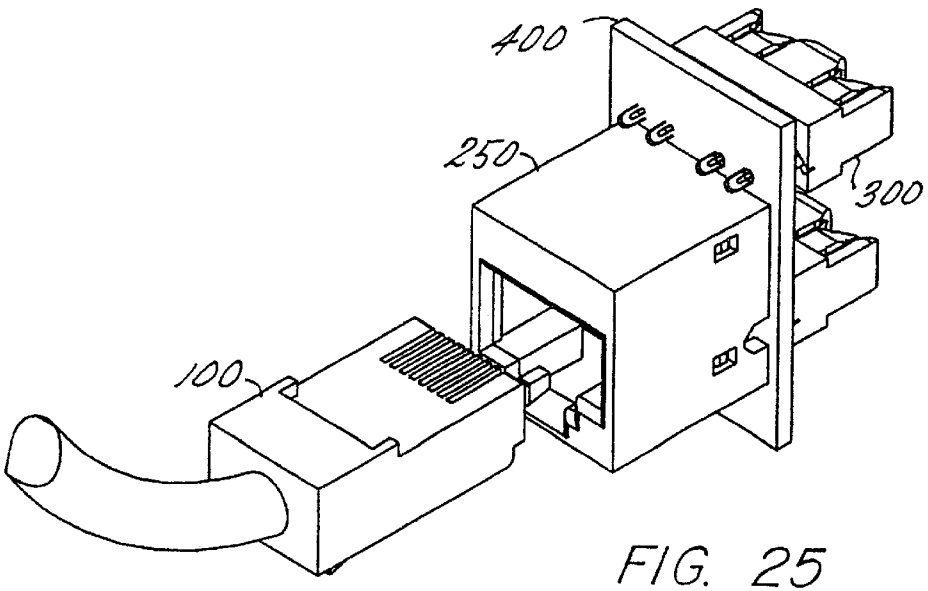

FIGS. 23 and 24 are perspective views of the 90 degree outlet 200 mounted to a circuit board 400. Connecting block 300 is mounted on the opposite side of the circuit board 400. FIGS. 23 and 24 also depict the plug 100 aligned with but not connected with outlet 200. FIGS. 25 and 26 are perspective views of the vertical outlet 250 mounted to a circuit board 400. Connecting block 300 is mounted on the opposite side of the circuit board 400. FIGS. 25 and 26 also depict the plug 100 aligned with but not connected with outlet 250. As described above, the plug, outlet and connecting block are all designed to provide enhanced performance and provide an enhanced performance connector when these components are used together. Although the embodiments described herein are directed to an 8 contact version, it is understood that the features of the outlet, plug and connecting block can be implemented regardless of the number of contacts (e.g. 10, 6, 4, 2).

As connectors are required to meet higher transmission requirements, the connectors often require circuitry to compensate for the crosstalk. This means that the circuitry is often "tuned" to a certain range of plug performance. Conventional plugs often have a wide range of performance and thus can become out of "tune" with the compensation circuitry resulting in the connector not meeting transmission requirements. As the transmission frequencies increase, the amount of compensation created in the compensation circuitry increases, and in turn, the permissible variance in plug performance decreases. Causes that can be associated with a wide range of transmission performance in prior art plugs are as follows:

A. Varying amounts of pair untwist. The plug does not include a mechanism for controlling the amount of untwist in the individual pairs.

B. Inconsistent location of pairs relative to each other. There is no method of locating wires in the plug, therefore, the pairs can get tugged, bent, or twisted in many different ways.

C. Conventional plugs require that the wires must be pushed through the load bar into the plug. This can cause wires to buckle and also increases the difficulty involved with assembling these plugs.

D. The fact that the two ends of the cable used have a mirror image orientation of the pairs, and thus can not be assembled the same way creates inconsistencies as well.

Figure 27:
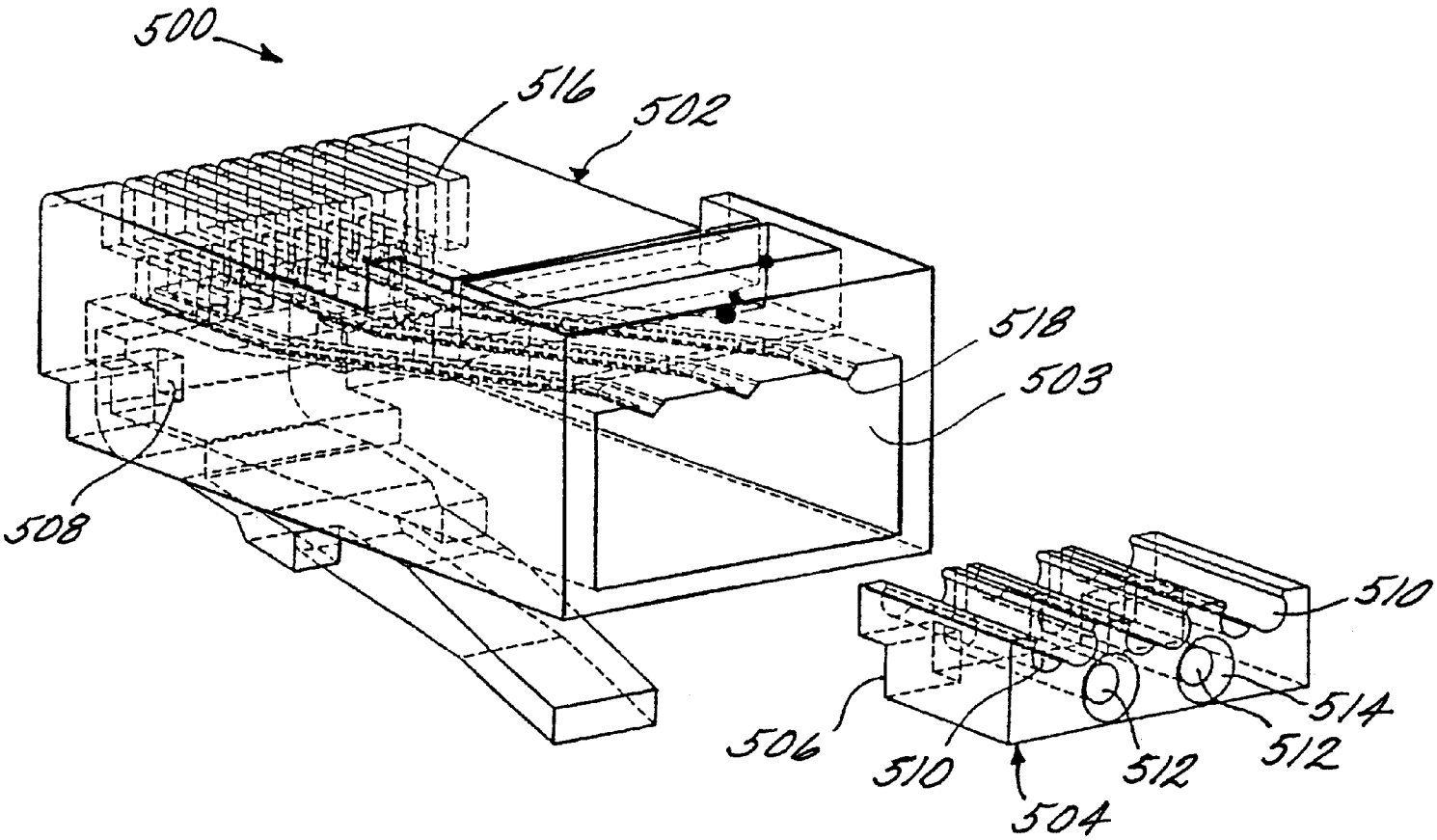
FIG. 27 is an exploded perspective view of an alternative plug.

FIG. 27 is an exploded, perspective view of an alternative plug shown generally at 500 designed to provide more consistent performance. Plug 500 includes a housing 502 and a load bar 504. The housing is designed to mate with already existing RJ45 outlets (i.e. backwards compatibility). As will be described in more detail below, load bar 504 receives wires and positions the wires in proper locations for reducing crosstalk. Load bar 504 is inserted through opening 503 in housing 502. Load bar 504 is generally rectangular and includes recesses 506 that receive shoulders 508 formed in the interior of housing 502. Load bar 504 includes a first set of wire receiving channels 510 arranged in a first plane and a second set of wire receiving channels 512 positioned in a second plane different from the first plane. In a preferred embodiment, the first plane is substantially parallel to the second plane. The wire receiving channels 510 are wide enough to slip the wires in, but narrow enough, that once the wires are in position the wires are held in place during the loading process. Wire receiving channels 512 include a tapered entrance 514 to facilitate installation of the wire. A series of separate slots 516 are formed in the housing 500 for providing a path for an insulation displacement contact to contact wires positioned in wire receiving channels 510 and 512. The slots 516 are separate thereby preventing adjacent insulation displacement contacts from touching each other. Three ridges 518 are formed on the inside of housing 502. Each ridge 518 is positioned between two adjacent wire receiving channels 510 and aids in positioning the wires relative to slots 516. The load bar 504 shown in FIG. 27 is designed to receive eight wires, six in the first plane and two in the second plane. It is understood that the plug 500 can be modified to receive more or less wires without departing from the invention.

Figure 28:
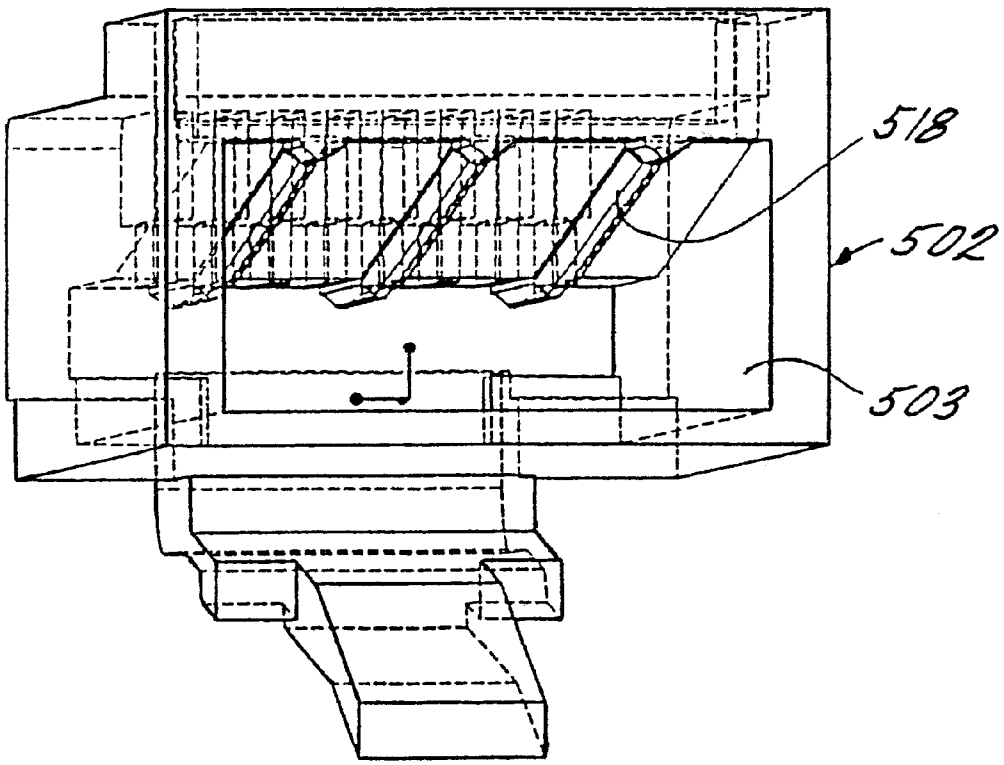
FIG. 28 is a perspective view of the housing of the plug in FIG. 27.

FIG. 28 is a perspective view of the housing 502. Ridges 518 angle downwards towards the load bar and then proceed parallel to the wire receiving channels 510 in load bar 504. The angled opening in housing 502 facilitates insertion of the load bar 504 into housing 502.

Figure 29:
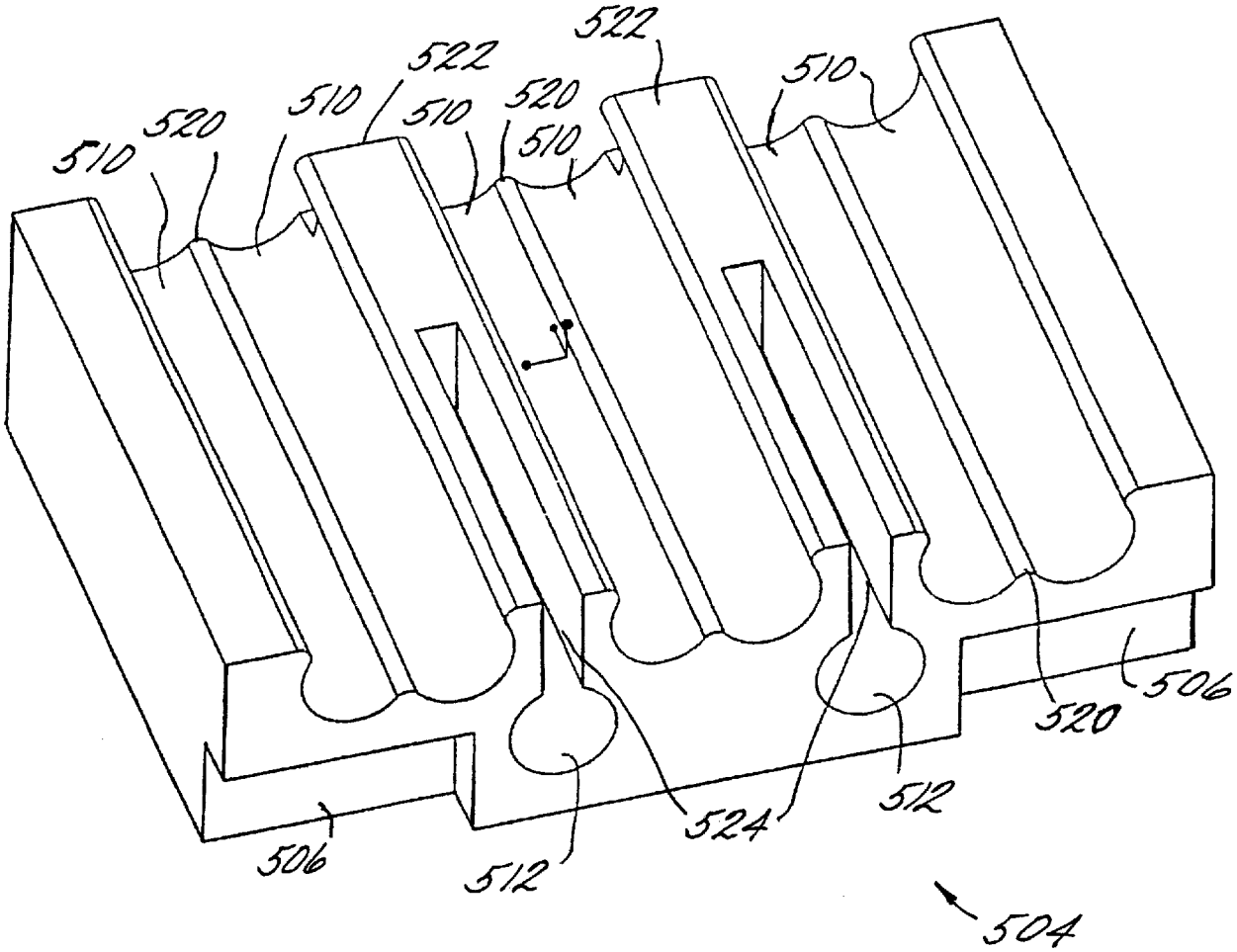
FIG. 29 is a perspective view of the load bar of the plug of FIG. 27.

FIG. 29 is a perspective view of the load bar 504. Each wire receiving channel 510 is semi-circular. Adjacent wire receiving channels 510 receive a tip and ring conductor from a respective pair and have a lip 520 positioned therebetween to position the wires accurately. A barrier 522 is provided between adjacent pairs of wire receiving channels 510. Barriers 522 help keep tip and ring conductors from different pairs from being crossed and have a height greater than that of the wires. Barriers 522 are positioned directly above wire receiving channels 512 in the second plane.

As shown in FIG. 29, wire receiving channels 512 straddle a central pair of wire receiving channels 510 in accordance with conventional wiring standards. Barriers 522 include slots 524 formed through the top surface of barrier 522 and entering wire receiving channel 512. Slots 524 provide an opening for an insulation displacement contact to contact wires placed in wire receiving channels 512. Slots 524 are aligned with slots 516 in housing 502 when the load bar 504 is installed in the housing.

Figure 30:
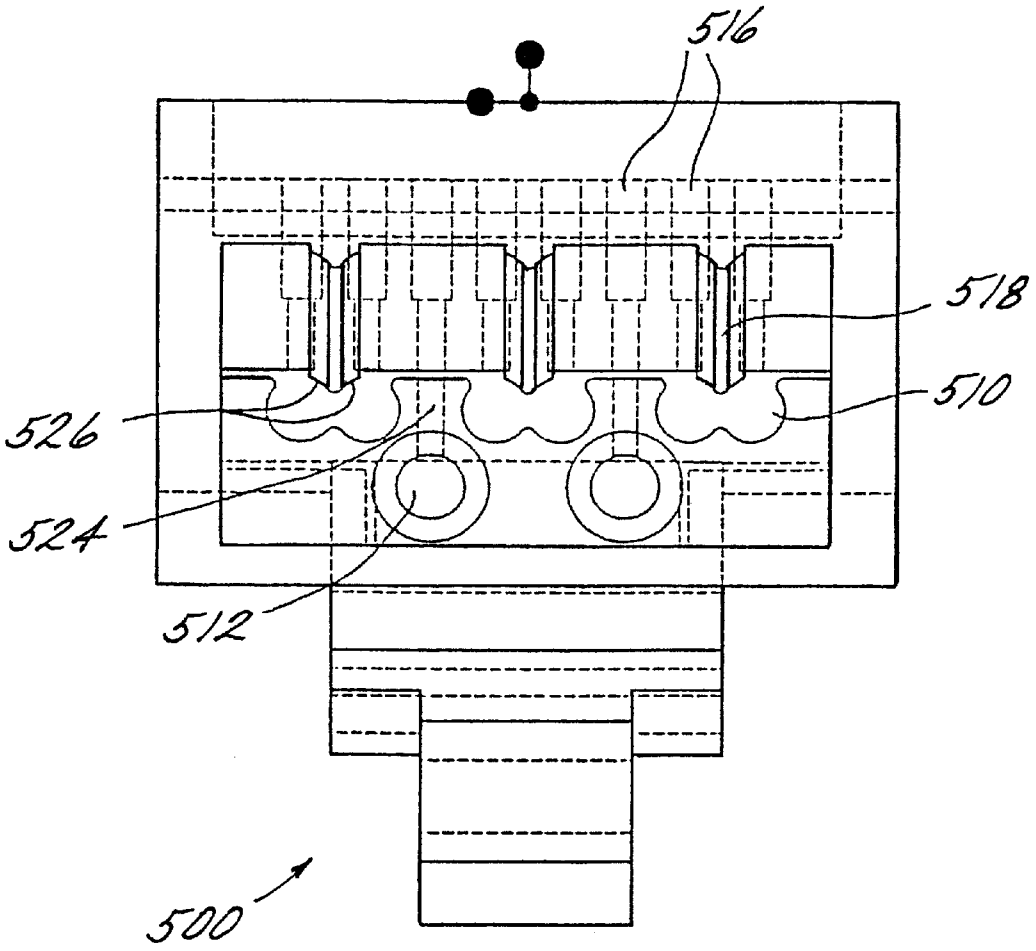
FIG. 30 is an end view of the plug of FIG. 27.

FIG. 30 is an end view of plug 500 with the load bar 504 installed in the housing 502. Ridges 518 include opposed semi-circular surfaces that have a similar radius to the semi-circular surface of wire retaining channels 510. Opposed semi-circular surfaces 526 help position the wires in the wire receiving channels 510 so that the wires are aligned with the slots 516 in housing 502. A first surface 526 is directed towards one of the wire receiving channels 510 and the opposite surface 526 is directed towards the other wire receiving channel 510 of a pair of adjacent wire receiving channels. Ridges 518 are substantially parallel to wire receiving channels 510 and extend along the entire length of the wire receiving channels 510. Insulation displacement contacts are positioned in slots 516 and engage the wires in wire receiving channels 510 and 512. As is known in the art, longer insulation displacement contacts are needed to engage the wires in wire receiving channels 512.

Figure 31B:
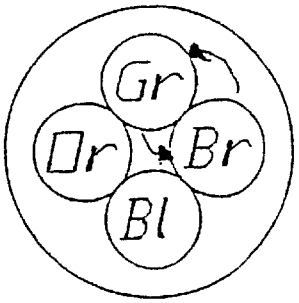
FIG. 31B is an end view of one end of the cable.
Figure 31C:
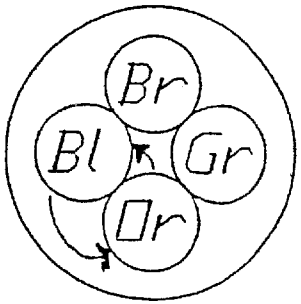
FIG. 31C is an end view of another end of the cable.
Figure 31A:
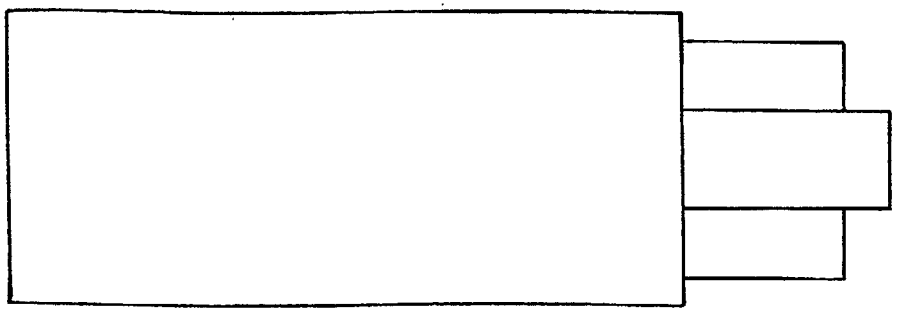
FIG. 31A is a side view of a cable.

Installation of wires in the load bar 504 will now be described. FIGS. 31A and 31B are side and end views, respectively, of a cable having four pairs of wires. The four pairs are labeled Gr (green), Br (brown), Bl (blue) and Or (orange). Each pair includes two wires, one wire designated the tip conductor and the other wire designated the ring conductor. In the un-installed state, the individual wires of each pair are twisted (i.e. the tip and ring conductors are twisted around each other). FIG. 31C is an end view of the opposite end of the cable shown in FIG. 31B.

Figure 32:
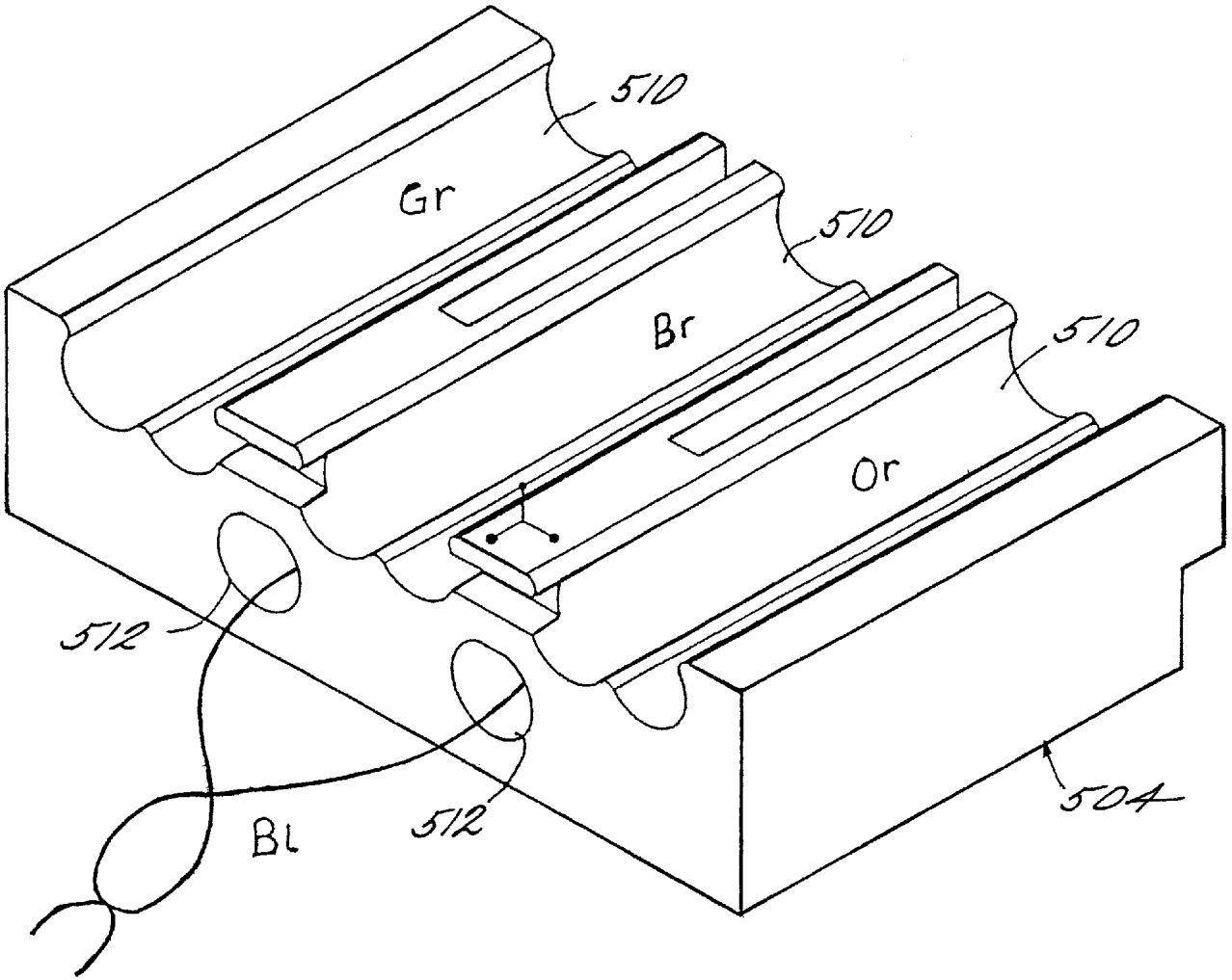
FIG. 32 is perspective view of the load bar of the plug of FIG. 27.

For the end of the cable shown in FIG. 31B, the load bar 504 will be loaded in the following way. First, the cable jacket will be stripped off approximately 1.5" from the end. Next, pairs Br and Gr will be swapped in position as shown in FIG. 31B. To do this, pair Gr will cross between pair Br and pair Bl. This will create a separation between pair Br and the split pair Bl. Pair Bl is referred to as the split pair because it is spread over an intermediate pair in conventional wiring standards. As shown in FIG. 32, pair Br is positioned between the conductors of the split pair Bl. The tip and ring wires of the Bl pair will be untwisted up to a maximum of 0.5" from the cable jacket, such that the wires in the pair are oriented correctly. The Bl pair will then be laced into the load bar 504 in wire receiving channels 512 as shown in FIG. 32, and pulled through until the twisted wires contact the load bar. The remaining pairs Or, Br and Gr will be untwisted as little as necessary and placed in their appropriate wire receiving channels 510 such that no pairs are crossed. The tip and ring conductors for each pair are kept adjacent in wire receiving channels 510. The wires are then trimmed as close to the end of the load bar 504 as possible.

The pairs that are kept together, Or, Br and Gr are positioned in the first plane of wire receiving channels 510. The split pair Bl that straddles another pair Br, in accordance with conventional wiring standards, is placed in the second plane of wire receiving channels 512. The split pair Bl usually contributes greatly to near end crosstalk (NEXT). By positioning this pair in a second plane defined by wire receiving channels 512, separate from the first plane defined by wire receiving channels 510, the crosstalk generated by the split pair is reduced.

For the end of the cable shown in FIG. 31C the load bar will be loaded in the following way. First, the cable jacket will be stripped off approximately 1.5" from the end. Next pairs Or and pair Bl will be swapped in position as shown in FIG. 31C. To do this, pair Or will cross between pair Br and pair Bl. This will create a separation between pair Br and the split pair Bl. The wires are then placed in the load bar 504 as described above.

The load bar 504 is then inserted into the housing 502. There is a slight interference fit between the load bar 504 and the housing 502 that secures the load bar 504 to the housing 502. Recesses 506 receive shoulders 508 in the housing 502. When the load bar 504 is properly positioned in the housing, wire receiving channels 510 are aligned with slots 516. The two slots 524 and two wire receiving channels 512 are also aligned with two slots 516. Contact blades having insulation displacement ends are then positioned in slots 516 and crimped so as to engage the wires in the wire receiving channels 510 and 512. It is understood that the contact blades for the split pair positioned in wire receiving channels 512 will be longer than the contact blades for the wires positioned in wire receiving channels 510. Telecommunications plug 500 provides several advantages. First, the amount of untwist in each pair is minimized and controlled by the load bar. The location of each pair is also regulated by the load bar and the load bar prevents buckling of wires because the wires do not have to be pushed into the plug. Thus, the plug has a very small and consistent range of transmission performance. This is advantageous particularly when crosstalk compensation circuitry must be tuned to the plug performance. Terminating the wire inside the load bar creates a more simple final assembly.

FIGS. 33–36 are figures directed to an alternative ninety degree outlet shown generally at 600. Outlet 600 includes a housing a contact carrier similar to those described above. Contact 602 and 604 alternate across the outlet 600.

Figure 33:
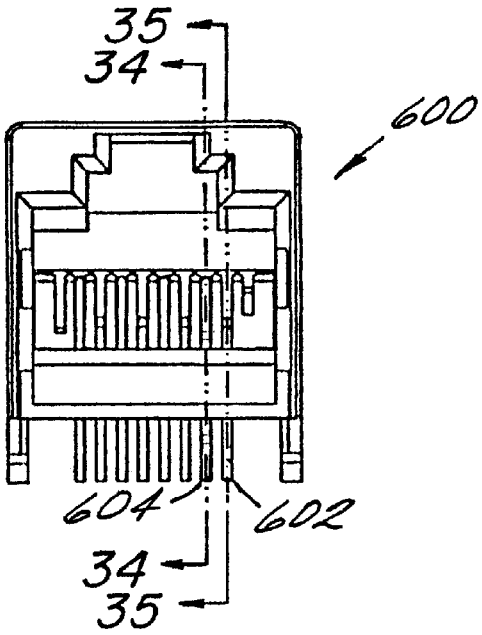
FIG. 33 is a front view of the alternative outlet.
Figure 34:
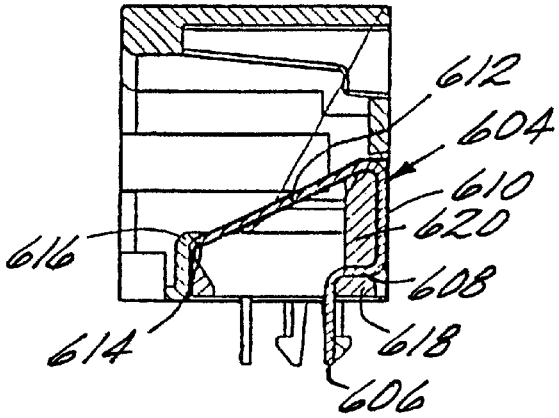
FIG. 34 is a cross-sectional view taken along line 34—34 of FIG. 33.

FIG. 34 is a cross sectional view of the outlet 600 taken along line 34—34 of FIG. 33. FIG. 34 shows in detail a first contact 604. First contact 604 has a termination end 606 that engages a circuit board. From the termination end 606, contact 604 enters the base of the contact carrier and bends approximately 90 degrees to form leg 608. Contact 604 then bends approximately 90 degrees to define leg 610. Contact 604 bends more than 90 degrees to define leg 612. Leg 612 exits the rear wall at a first height relative to the bottom of the base of the contact carrier and exits at an oblique angle relative to the rear wall. The distal end 614 of contact 604 is positioned under a rearwardly facing lip 616 formed on the housing and positioned above the front edge of the contact carrier. The path for contact 604 is formed in part by first member 618 and second member 620 positioned in the contact carrier. A gap is provided between first member 618 and second member 620 to receive leg 608.

Figure 35:
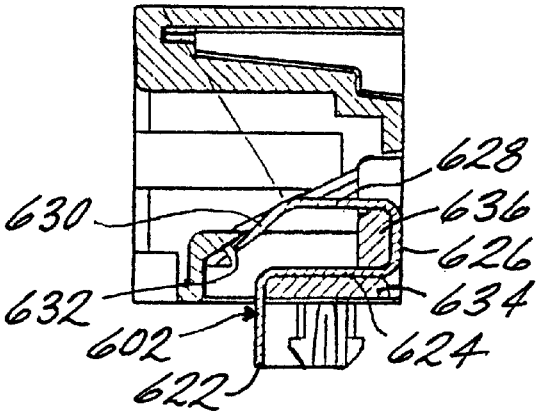
FIG. 35 is a cross-sectional view taken along line 35—35 of FIG. 33.

FIG. 35 is a cross sectional view of the outlet 600 taken along line 35—35 of FIG. 33. FIG. 35 shows in detail a second contact 602. Contact 602 has a termination end 622 that engages a circuit board. From the termination end 622, contact 602 enters the base of the contact carrier and bends approximately 90 degrees to form leg 624. Contact 602 then bends approximately 90 degrees to define leg 626. Contact 602 bends approximately 90 degrees to define leg 628 that exits the rear wall at a second height relative to the bottom of the contact carrier and substantially perpendicular to rear wall. Contact 602 bends less than 90 degrees and the distal end 632 terminates below rearwardly facing lip 616 formed on housing and positioned above the front edge of the contact carrier. The path for contact 602 is formed in part by third member 634 and fourth member 636 positioned in the contact carrier. A gap is provided between first member 634 and second member 636 to receive leg 624.

Figure 36:
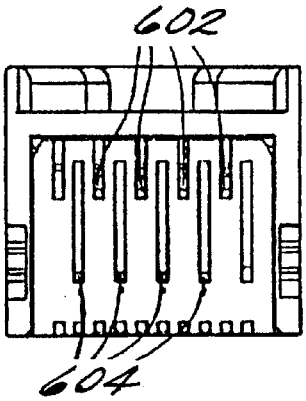
FIG. 36 is a bottom view of the alternative outlet.

FIG. 36 is a bottom view of outlet 600. The outlet 600 also reduces crosstalk in the area where the contacts 602 and 604 mate with the circuit board by spacing the row of contacts 602 and row of contacts 604 further apart than standard modular jacks (typically 0.100 in).

The contacts 602 and 604 exiting the rear wall of the contact carrier at different heights and at different angles is an important feature of the present invention. By alternating contacts 602 and 604 across the contact carrier, and having contacts 602 and 604 exit the rear wall of the contact carrier at different heights and at different angles reduces the amount of adjacent area between neighboring contacts 602 and 604. This reduction enhances performance by reducing crosstalk, improving return loss and achieving better balance.

Figure 38:
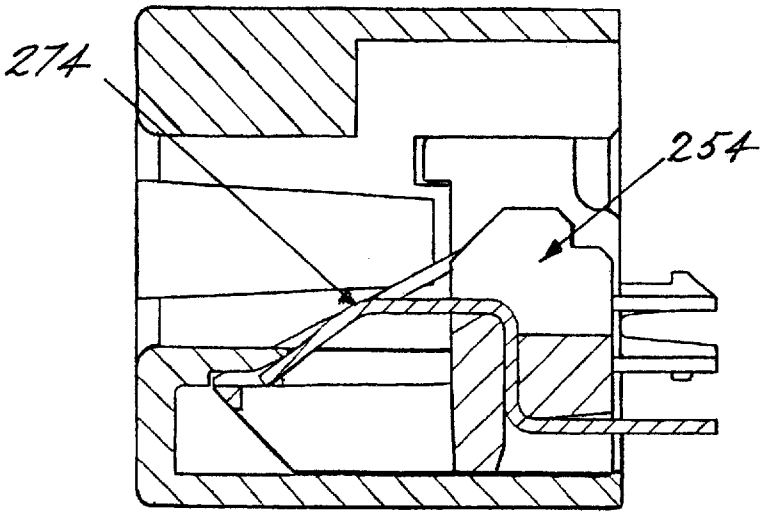
FIG. 38 is a cross-sectional view taken along line 38—38 of FIG. 37.

FIGS. 37–42 are views of another alternative outlet shown generally at 700. Outlet 700 includes a contact carrier 254 similar to that described above with reference to FIGS. 11–16. Outlet 700 includes eight contacts located in positions 1–8 as indicated by the numbers on the face of the outlet. Each contact is shaped to enhance performance and reduce crosstalk as described herein with reference to FIGS. 38–42. FIG. 38 is a cross-sectional view taken along line 38—38 of FIG. 37 and depicts contact 274. Contact 274 is identical to contact 274 described above with reference to FIGS. 13–16. Contact 274 is located in positions 1, 3, 5 and 7 in outlet 700. The contact 274 in slot 1 may be made from berrilium-copper which is more resilient than phosphor-bronze contacts. Certain plugs lack contacts at positions 1 and 8 and tend to apply excessive force on contacts 1 and 8 in outlet 700. Making contacts in slots 1 and 8 from berrilium-copper prevents deformation of the contacts in slots 1 and 8 when such plugs are used. In addition, contacts in slots 1 and 8 may exit the rear wall 258 of contact carrier 254 closer to base 256 than contacts in slots 3, 5 and 7. This reduces the amount of deflection of contacts in slots 1 and 8 when plugs lacking contacts at positions 1 and 8 are mated to outlet 700.

Figure 37:
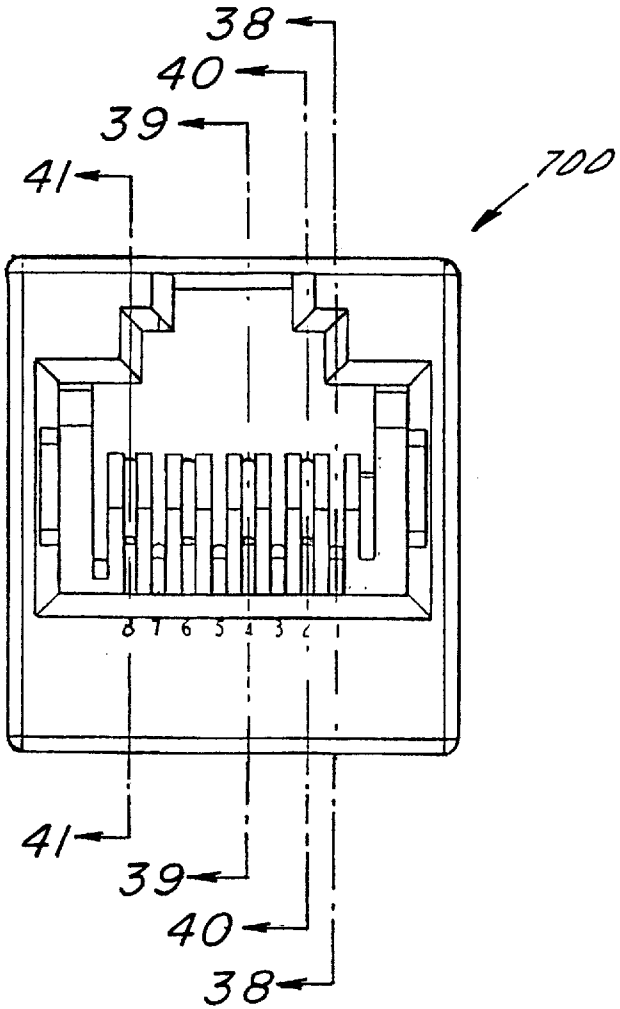
FIG. 37 is a front view of another, alternative outlet.
Figure 39:
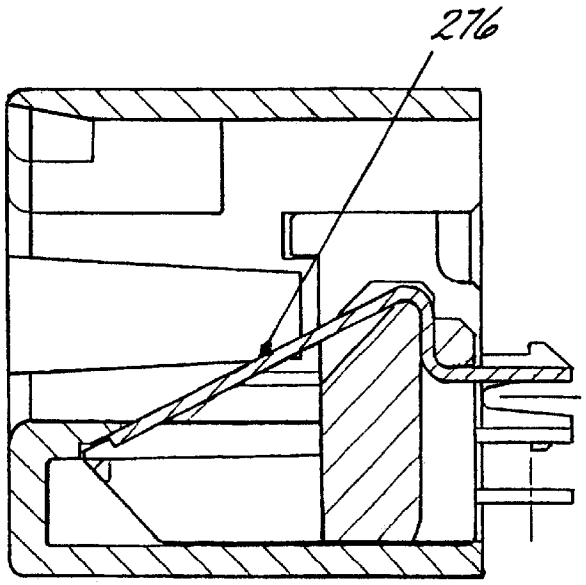
FIG. 39 is a cross-sectional view taken along line 39—39 of FIG. 37.

FIG. 39 is a cross-sectional view taken along line 39—39 of FIG. 37 and depicts contact 276. Contact 276 is identical to contact 276 described above with reference to FIGS. 13–16. Contact 276 is located in positions 4 and 6 in outlet 700.

Figure 40:
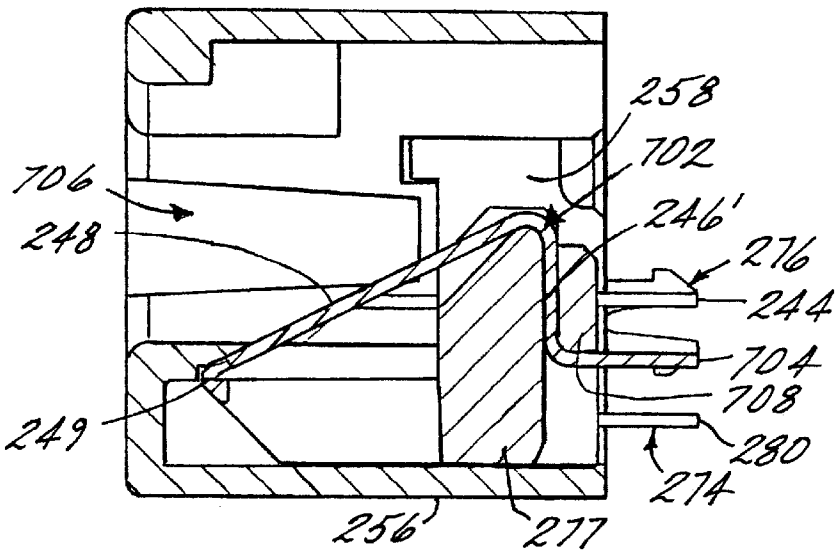
FIG. 40 is a cross-sectional view taken along line 40—40 of FIG. 37.

FIG. 40 is a cross-sectional view taken along line 40—40 of FIG. 37 and depicts contact 702. Contact 702 is located in position 2 in outlet 700. Contact 702 has a termination end 704 extending from the rear wall of the contact carrier for mounting in a circuit board as described above. Contact 702 is bent approximately 90 degrees to define leg 246' which is bent more than 90 degrees to define leg 248. Leg 248 exits the rear wall 258 and extends into opening 706 at a second height relative to the bottom of the base 256 different than the exit height of first contact 274 and exits at an oblique angle relative to the rear wall 258. The path for contact 702 is formed in part by third member 277 and fifth member 708 positioned in rear wall 258. A gap is provided between third member 277 and fifth member 708 to receive leg 246'. Contact 702 is similar to contact 276 in that contact 702 exits rear wall 258 and extends into opening 706 at the same height and same angle as contact 276. The difference between contact 702 and 276 is that leg 246' is longer than leg 246 in FIG. 15. Thus, termination end 704 is positioned at a height different than the termination ends 244 and 280 of contacts 276 and 274, respectively. As will be described with reference to FIG. 42, this arrangement of contacts enhances performance of the outlet.

Figure 41:
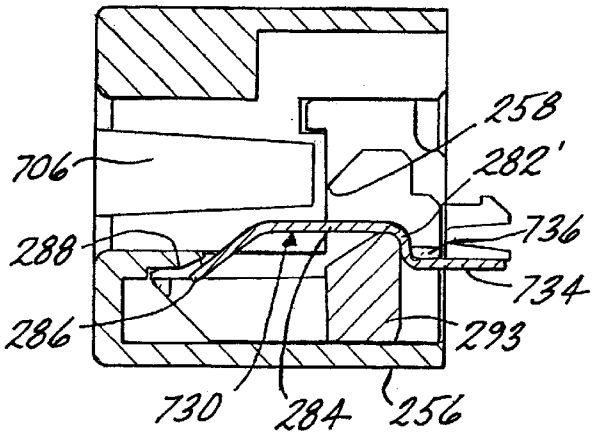
FIG. 41 is a cross-sectional view taken along line 41—41 of FIG. 37.

FIG. 41 is a cross-sectional view taken along line 41—41 of FIG. 37 and depicts contact 730. Contact 730 is located in position 8 in outlet 700. Contact 730 has a termination end 734 extending from the rear wall of the contact carrier for mounting in a circuit board as described above. From the termination end 734, contact 730 bends approximately 90 degrees to form leg 282'. Contact 730 then bends approximately 90 degrees to define leg 284 that exits the rear wall 258 at a first height relative to the bottom of the base 256 and substantially perpendicular to rear wall 258. Contact 730 bends less than 90 degrees and the distal end 286 terminates below rearwardly facing lip 288 formed on the housing as described above with reference to FIG. 14. The path for contact 730 is provided in part by a first member 293 and a sixth member 736. A gap is provided between first member 293 and sixth member 736 to receive leg 282'. Contact 730 is similar to contact 274 in that contact 730 exits rear wall 258 and extends into opening 706 at substantially the same height and same angle as contact 274. The difference between contact 730 and 274 is that leg 282' is shorter than leg 282 in FIG. 14. Thus, termination end 734 is positioned at a height different than the height of termination ends 244 and 280 of contacts 276 and 274, respectively. Distal end 734 is at the same height as distal end 704. As will be described with reference to FIG. 42, this arrangement of contacts enhances performance of the outlet.

Figure 42:
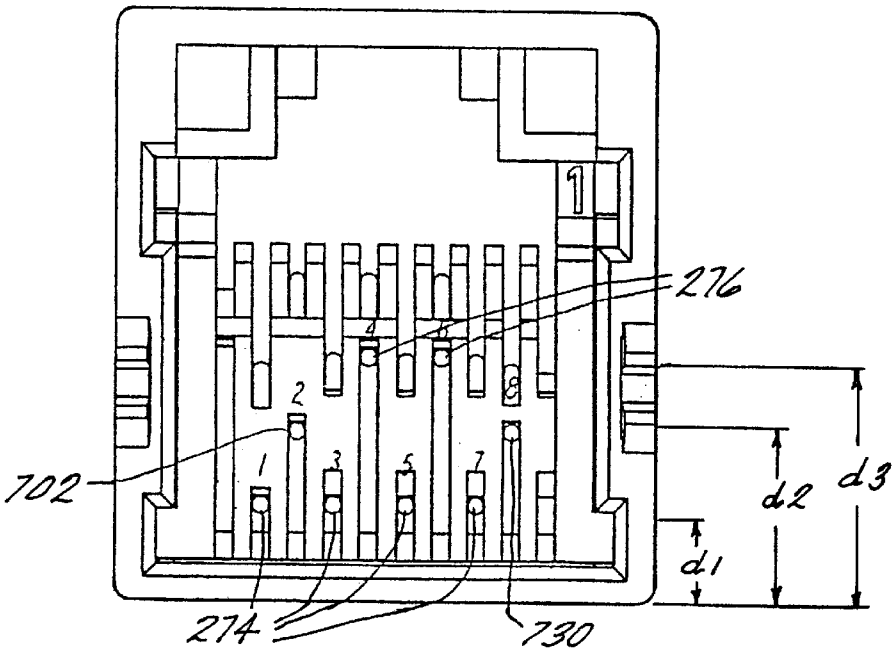
FIG. 42 is a bottom view of the outlet of FIG. 37.

As described above with respect to contact 274 in slot 1, contact 730 in slot 8 may be made from beryllium-copper to accommodate plugs lacking contacts in positions 1 and 8. As noted above, contact leg 284 may exit the rear wall 258 of contact carrier 254 closer to base 256 than contacts in slots 3, 5 and 7. This reduces the amount of deflection of contact 730 when plugs lacking contacts at positions 1 and 8 are mated to outlet 700. In addition, FIG. 42 is a rear view of outlet 700 showing the positions of the termination ends of the contacts 274, 276, 702 and 730. As shown in FIG. 42, the termination ends of contacts 274 in positions 1, 3, 5 and 7 are located in a row at a first distance d1 from an edge of the outlet 700. The termination ends of contacts 702 and 730 are located in positions 2 and 8 in a row at a second distance d2 from the edge of outlet 700. The termination ends of contacts 276 located in positions 4 and 6 are in a row at a third distance d3 from the edge of outlet 700. The location of contacts 274, 276, 702 and 730 in outlet 700 enhances the performance of the outlet 700 by reducing crosstalk between pairs of contacts.

FIGS. 43–48 are views of a ninety degree outlet shown generally at 800. Modular outlet 800 is a ninety degree outlet meaning that opening 802 for receiving a pug is in a plane that is approximately ninety degrees relative to the base 804 of the outlet where contacts exit the outlet for connection to a printed circuit board. The outlet 800 includes contacts positioned sequentially across the outlet 800 in locations referred to as 1–8 and is similar to outlet 200 described above with reference to FIGS. 5–10.

Figure 43:
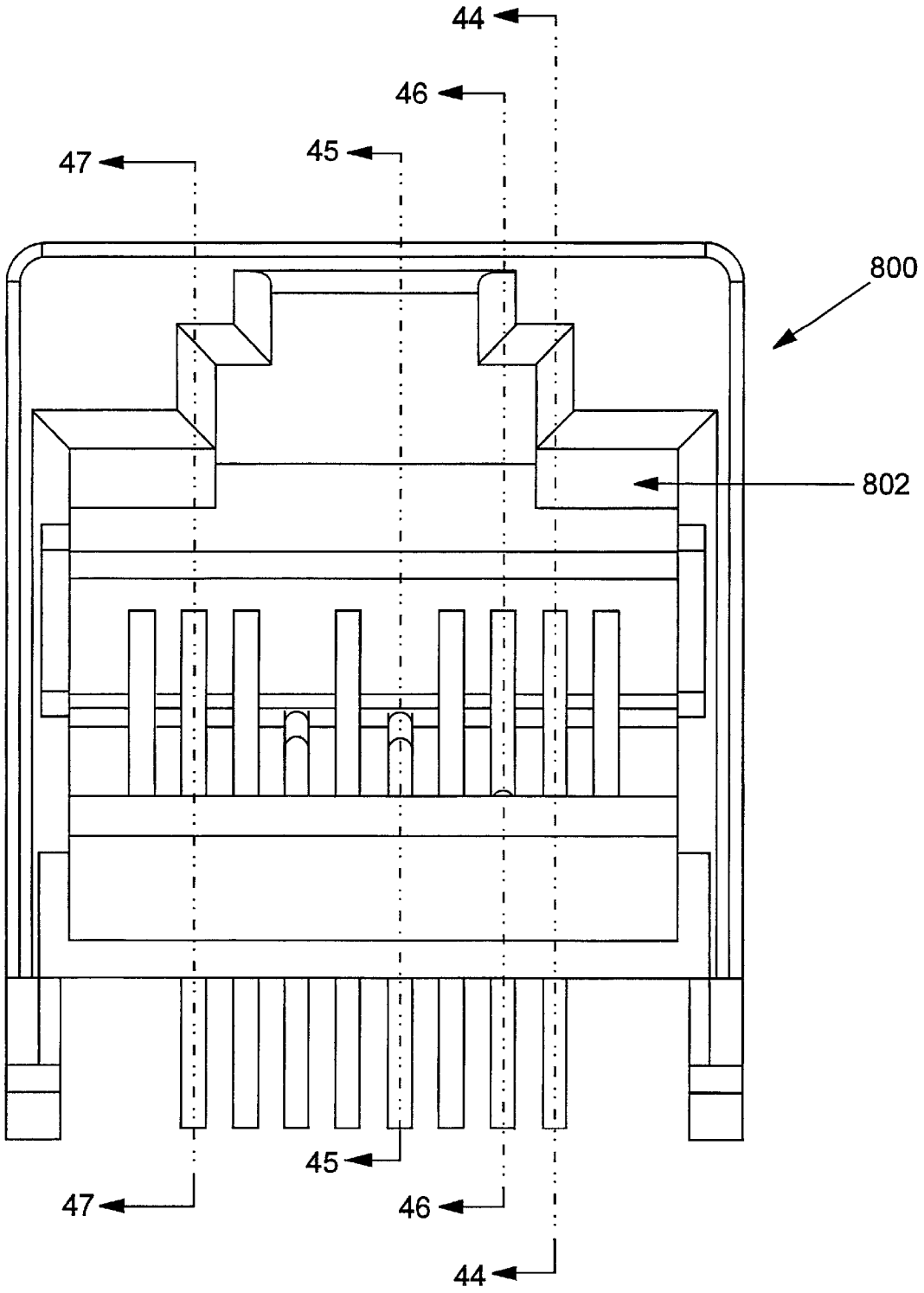
FIG. 43 is a front view of an alternate ninety degree outlet.
Figure 44:
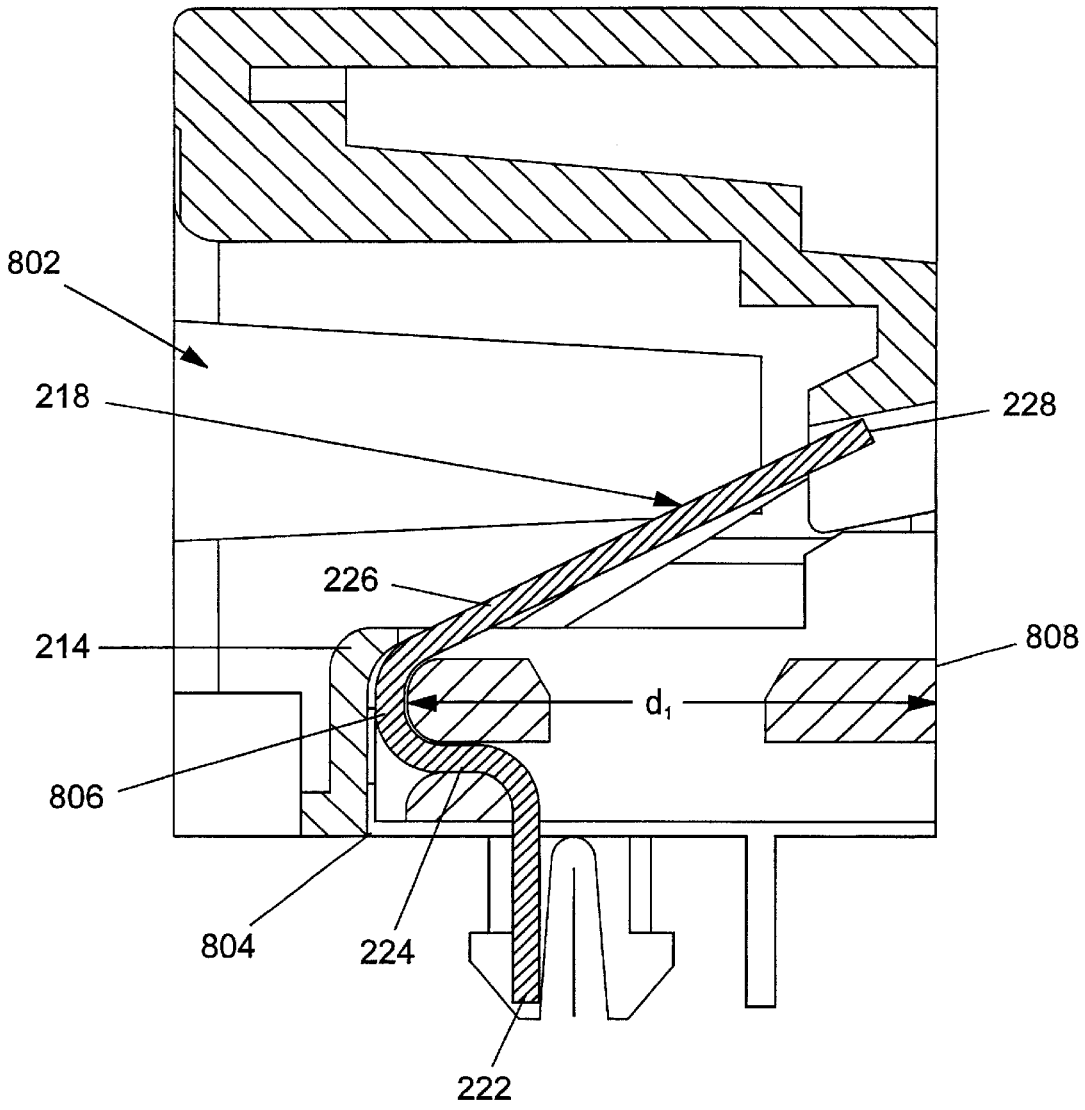
FIG. 44 is a cross sectional view taken along line 44—44 of FIG. 43.

FIG. 44 is a cross sectional view of outlet 800 taken along line 44—44 of FIG. 43. FIG. 44 depicts a contact 218 which is similar to contact 218 described above with reference to FIG. 8. Contact 218 is positioned in locations 1, 3, 5 and 7 in modular outlet 800. Contact 218 has a termination end 222 that engages a circuit board. From the termination end 222, contact 218 enters the bottom of contact carrier and bends approximately 90 degrees to form leg 224. Contact 218 then bends more than 90 degrees but less than 180 degrees at a knee 806 to define leg 226 that exits the contact carrier proximate to front edge 214. Knee 806 is positioned a first distance dl from rear edge 808 of outlet 800.

Figure 45:
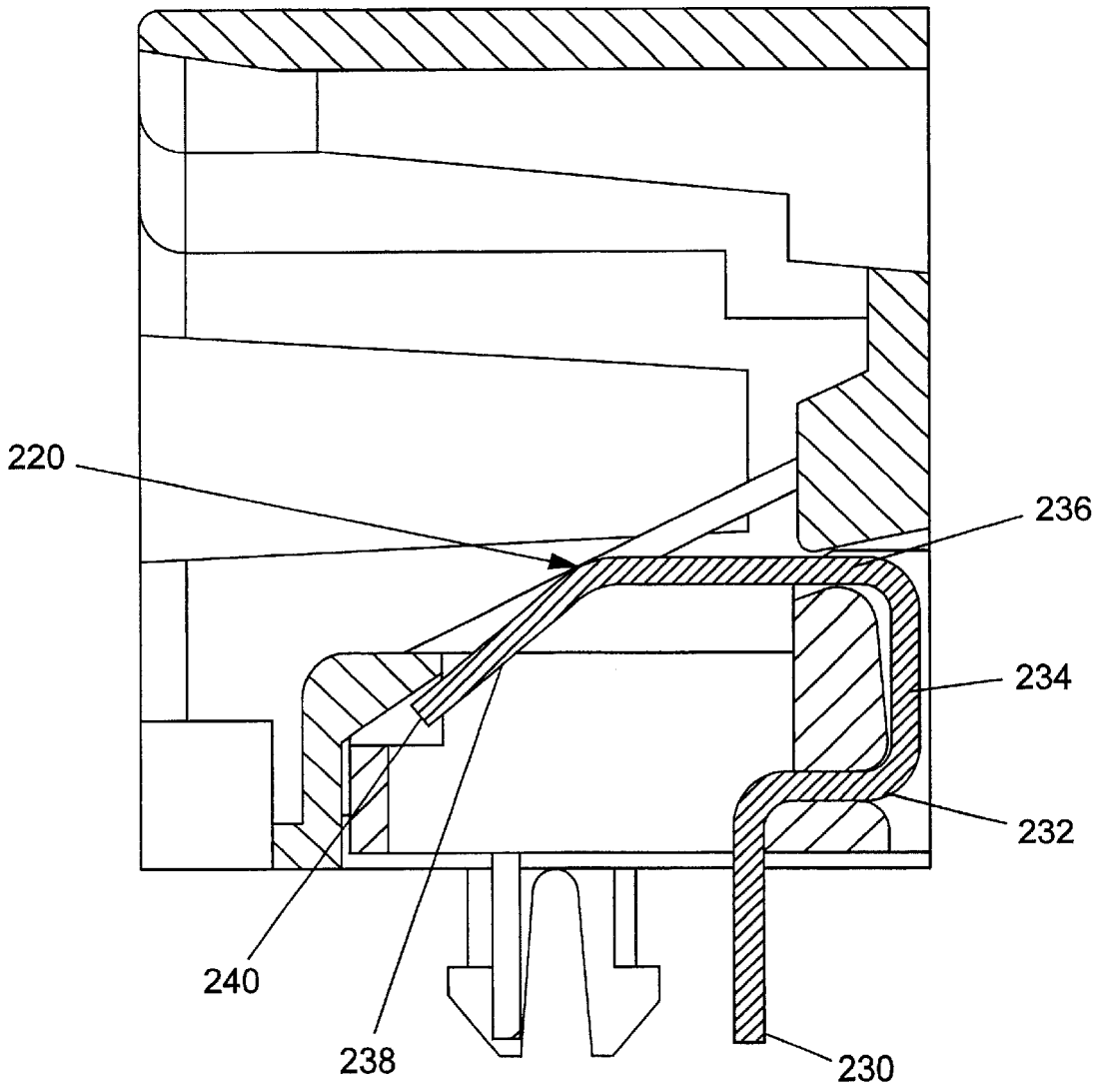
FIG. 45 is a cross sectional view taken along line 45—45 of FIG. 43.

FIG. 45 is a cross sectional view of outlet 800 taken along line 45—45 of FIG. 43. FIG. 45 depicts a contact 220 which is similar to contact 220 described above with reference to FIG. 9. Contact 220 is positioned in locations 4 and 6 in modular outlet 800. Contact 220 has a distal end 230 extending from the bottom of the contact carrier for mounting in a circuit board. Contact 220 is bent approximately 90 degrees to define leg 232 which is bent approximately 90 degrees to define leg 234. Leg 234 is bent approximately 90 degrees to define leg 236 which is bent less than 90 degrees to define leg 238. The distal end 240 of contact 220 is positioned under a rearwardly facing lip formed on the housing as described above with reference to FIG. 9.

Figure 46:
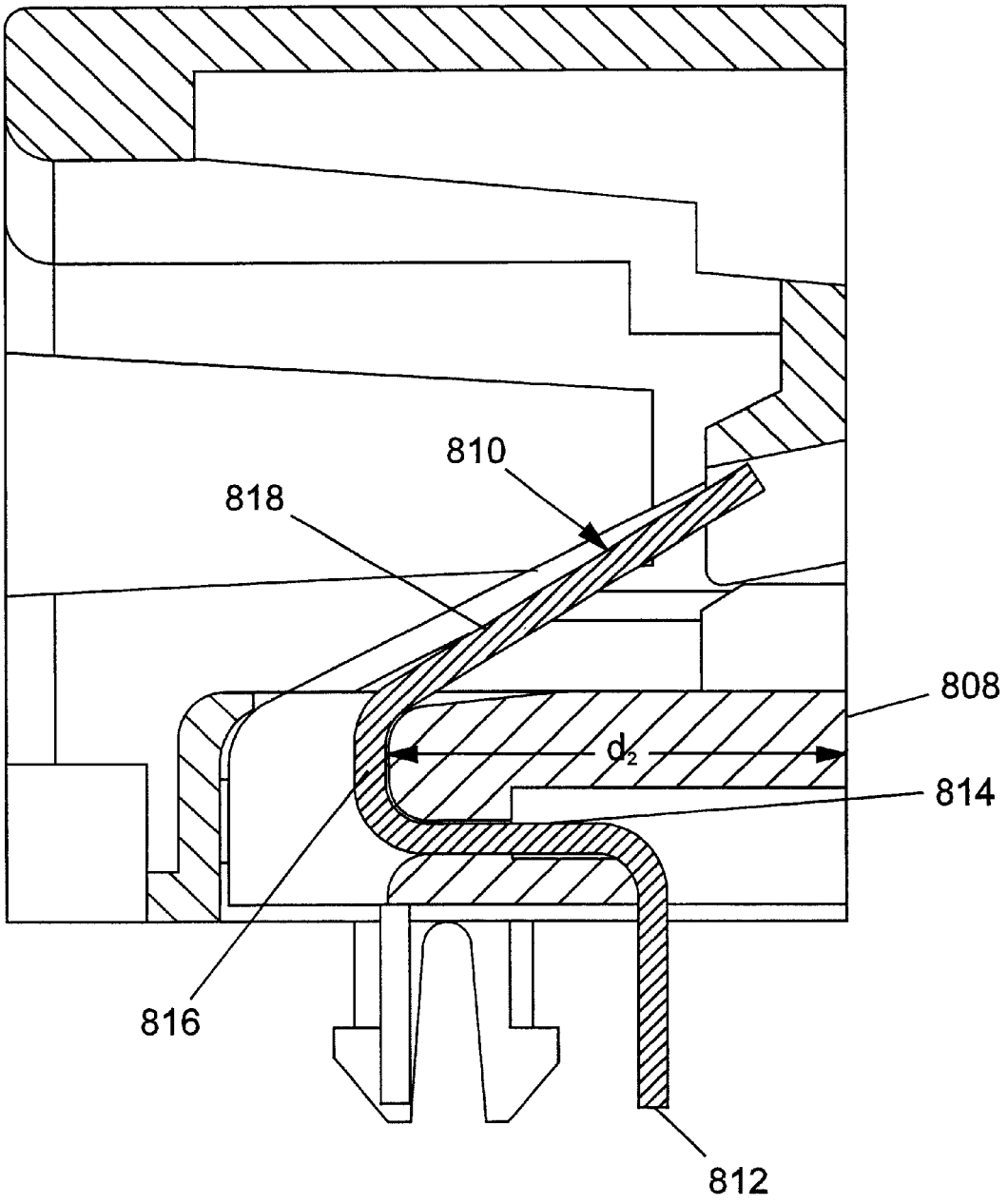
FIG. 46 is a cross sectional view taken along line 46—46 of FIG. 43.

FIG. 46 is a cross sectional view taken along line 46—46 of FIG. 43. FIG. 46 depicts a contact 810 which is similar in shape to contact 218. Contact 218 is positioned in location 2 in modular outlet 800. Contact 810 has a termination end 812 that engages a circuit board. From the termination end 812, contact 810 enters the bottom of the contact carrier and bends approximately 90 degrees to form leg 814. Contact 810 then bends more than 90 degrees but less than 180 degrees ataknee 816 to define leg 818 that exits the contact carrier. Knee 816 is positioned a second distance d2 from rear edge 808 of outlet 800. Positioning the knee 816 back from knee 806 distances the contact 810 in the second location from the contacts 218 in the first and third locations. Typically, the contacts are arranged in pairs such that locations 1 and 2 define a pair, locations 3 and 6 define a pair, locations 4 and 5 define a pair and locations 7 and 8 define a pair. Moving the knee 816 of contact 810 away from knee 806 of contact 218 increases separation between contacts of different pairs and reduces crosstalk.

Figure 47:
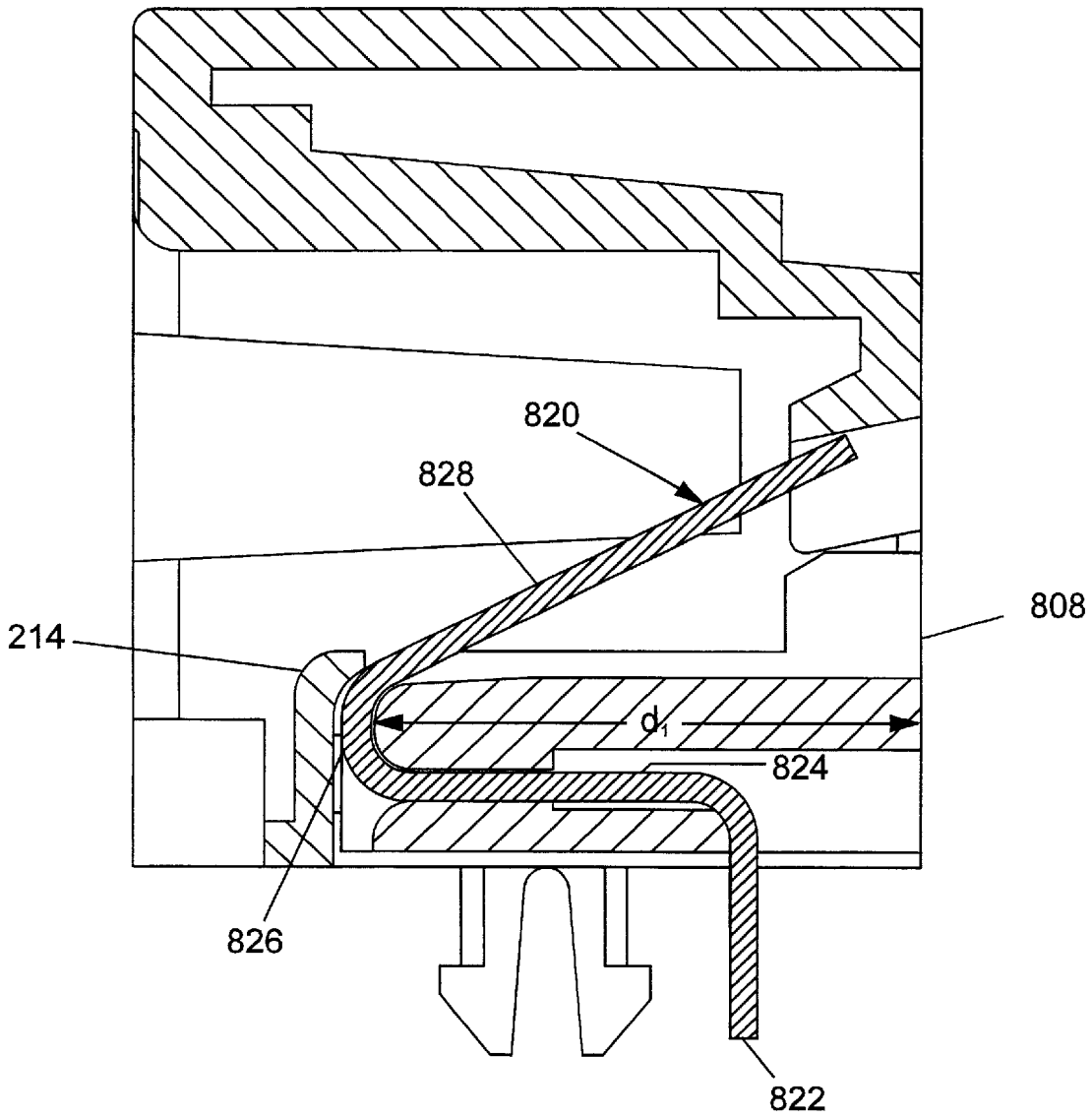
FIG. 47 is a cross sectional view taken along line 47—47 of FIG. 43.

FIG. 47 is a cross sectional view of outlet 800 taken along line 47—47 of FIG. 43. FIG. 47 depicts a contact 820 which is similar in shape to contact 218 but has different dimensions. Contact 820 is positioned in location 8 in modular outlet 800. Contact 820 has a termination end 822 that engages a circuit board. From the termination end 222, contact 820 enters the bottom of the contact carrier and bends approximately 90 degrees to form leg 824. Because the termination end 822 of contact 820 is in location 8, leg 824 has a length greater than the length of leg 224 in contact 218. Contact 820 then bends more than 90 degrees but less than 180 degrees at a knee 826 to define leg 828 that exits the contact carrier proximate to front edge 214. Knee 826 is positioned a first distance d1 from rear edge 808 of outlet 800.

Figure 48:
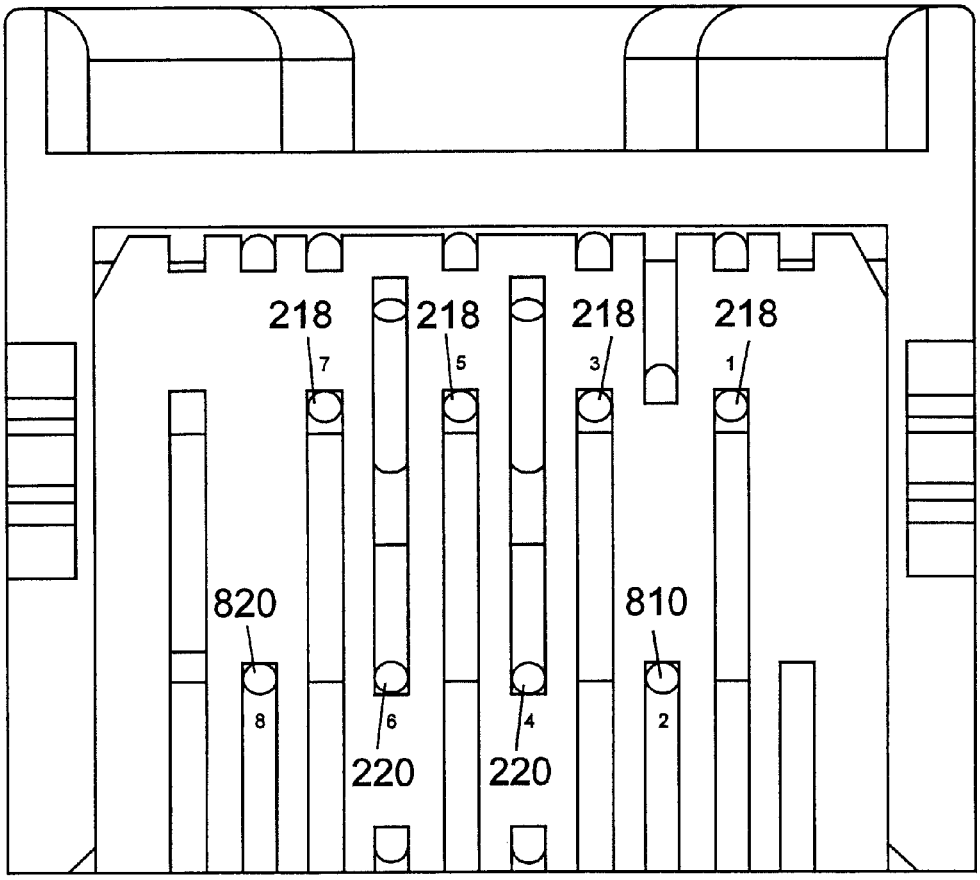
FIG. 48 is a bottom view of the outlet of FIG. 43.

FIG. 48 is a bottom view of outlet 800. As shown in FIG. 48, the termination ends of the contacts in locations 1–8 are arranged in two rows. A fist row of contact termination ends includes locations 1, 3, 5 and 7 and is made up of contacts 218. A second row of contact termination ends includes locations 2, 4, 6 and 8 and is made up of contacts 220, 810 and 820.

FIGS. 49–55 are view of an alternate vertical outlet shown generally at 900. Modular outlet 900 is a vertical outlet meaning that opening 902 for receiving a pug is in a plane that is approximately parallel to the rear 904 of the outlet where contacts exit the outlet for connection to a printed circuit board. The outlet 900 includes contacts positioned sequentially across the outlet 900 in locations referred to as 1–8 and is similar to outlets 250 and 700 described above with reference to FIGS. 11–16 and 37–42.

Figure 49:
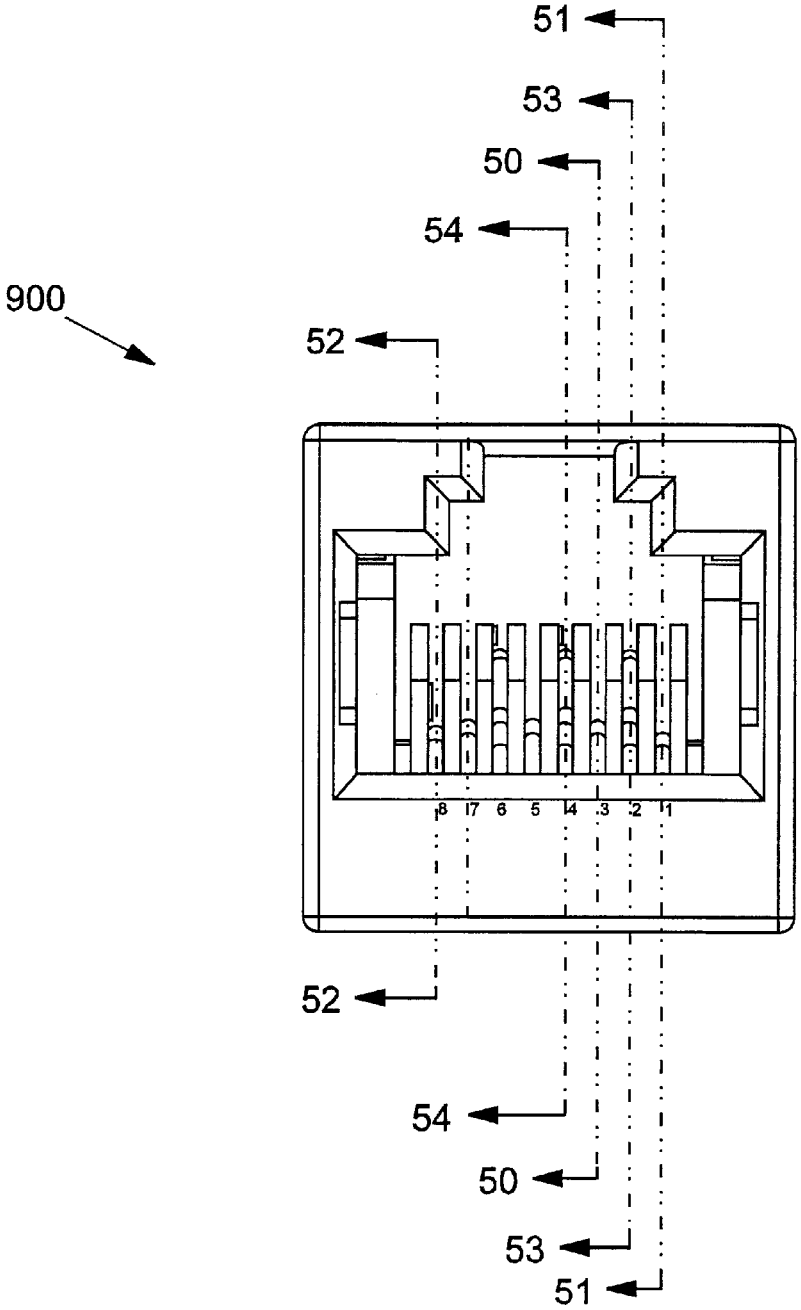
FIG. 49 is a front view of an alternate vertical outlet.
Figure 50:
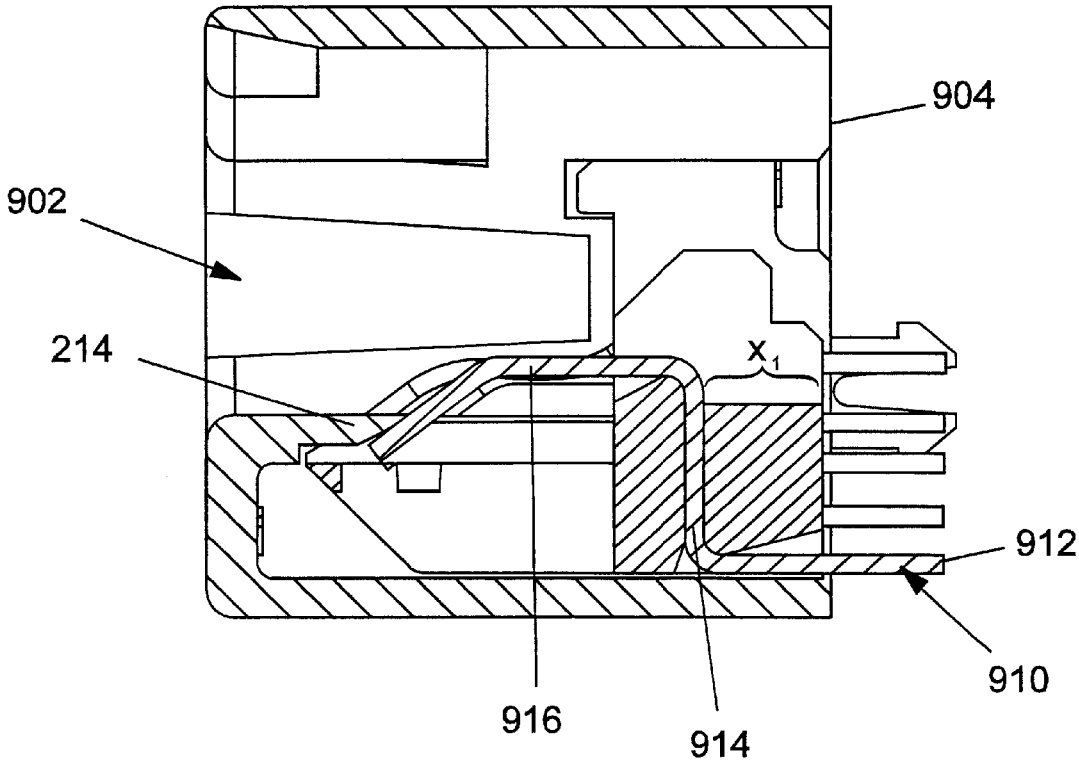
FIG. 50 is a cross sectional view taken along line 50—50 of FIG. 49.

FIG. 50 is a cross sectional view taken along line 50—50 of FIG. 49 depicting a contact 910. Contact 910 is positioned in locations 3 and 5 in modular outlet 900. Contact 910 has a termination end 912 that engages a circuit board. From the termination end 912, contact 910 enters the rear of the contact carrier and bends approximately 90 degrees to form leg 914. Leg 914 is positioned a distance x1 from a rear edge of the outlet 900. Contact 910 then bends approximately 90 degrees to define leg 916 which terminates under a front lip 214.

Figure 51:
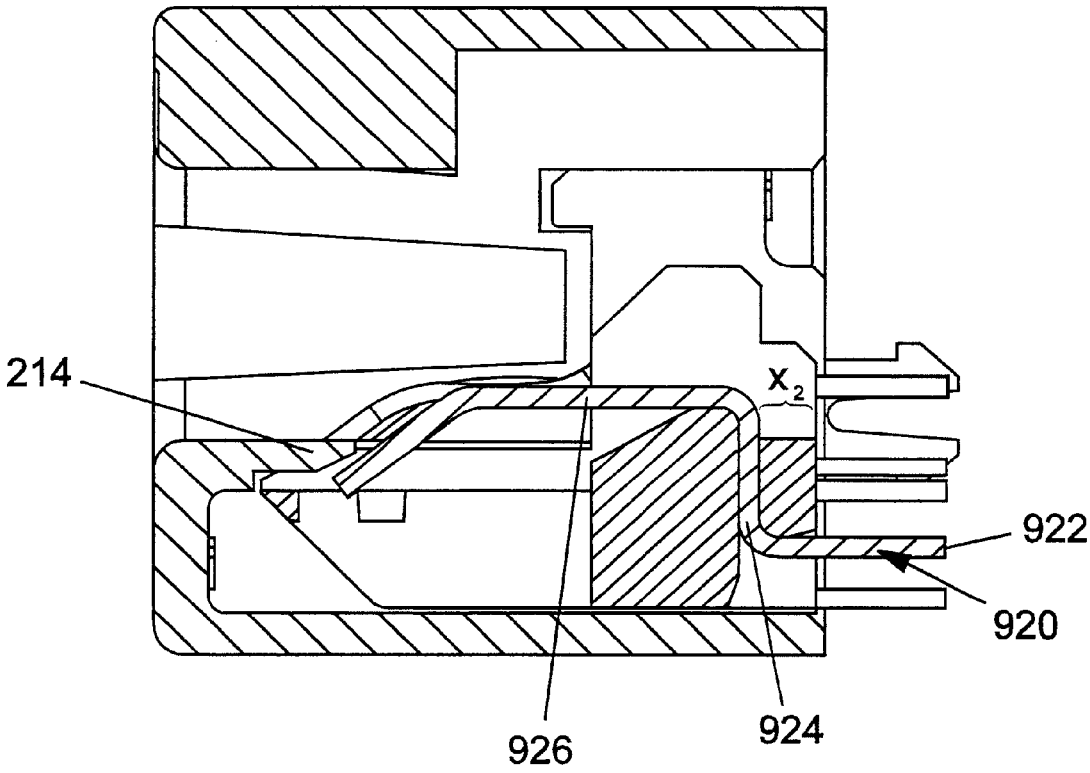
FIG. 51 is a cross sectional view taken along line 51—51 of FIG. 49.

FIG. 51 is a cross sectional view taken along line 51—51 of FIG. 49 depicting a contact 920. Contact 920 is positioned in locations 1 and 7 in modular outlet 900. Contact 920 has a termination end 922 that engages a circuit board. From the termination end 922, contact 920 enters the rear of the contact carrier and bends approximately 90 degrees to form leg 924. Leg 924 is positioned a distance x2 from a rear edge of the outlet 900. Contact 920 then bends approximately 90 degrees to define leg 926 which terminates under a front lip 214. The contact 920 in location 1 may be made from berrilium-copper which is more resilient than phosphor-bronze contacts. Certain plugs lack contacts at locations 1 and 8 and tend to apply excessive force on contacts 1 and 8 in outlet 900. Making contact 920 in location 1 from berrilium-copper prevents deformation of the contacts in location 1 when such plugs are used.

Figure 52:
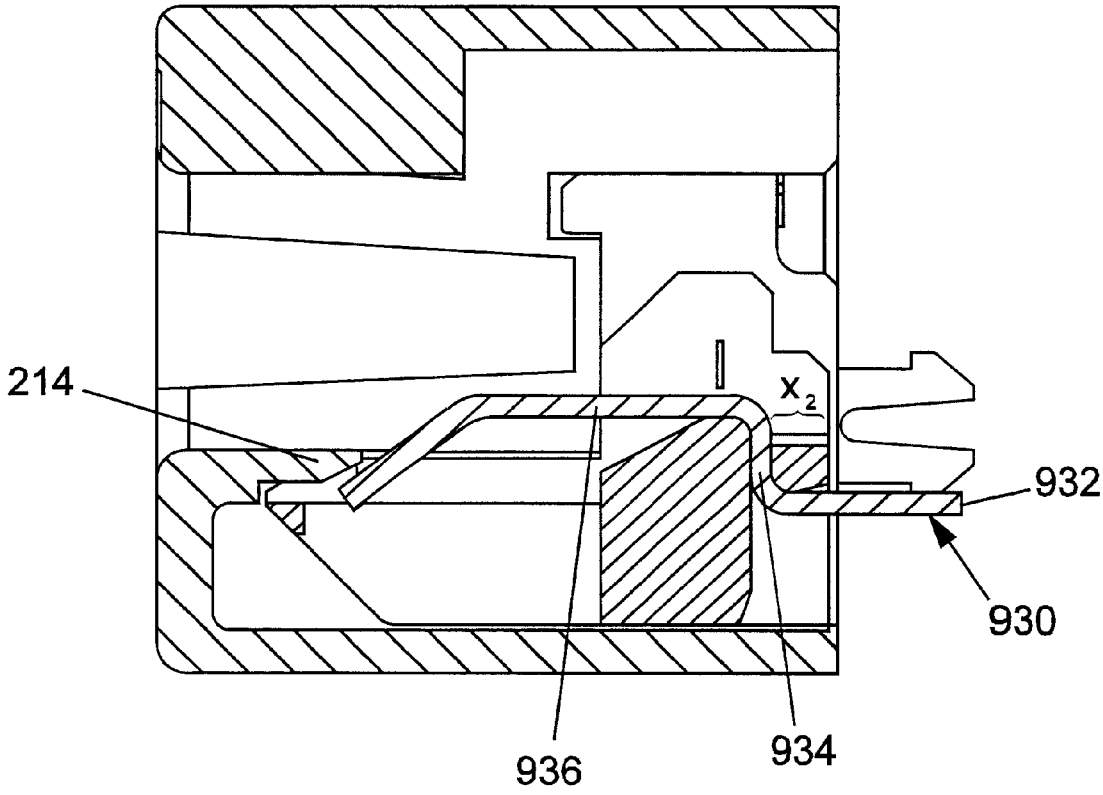
FIG. 52 is a cross sectional view taken along line 52—52 of FIG. 49.

FIG. 52 is a cross sectional view taken along line 52—52 of FIG. 49 depicting a contact 930. Contact 930 is positioned in location 8 in modular outlet 900. Contact 930 has a termination end 932 that engages a circuit board. From the termination end 932, contact 930 enters the rear of the contact carrier and bends approximately 90 degrees to form leg 934. Leg 934 is positioned a distance x2 from a rear edge of the outlet 900. Contact 930 then bends approximately 90 degrees to define leg 936 which terminates under a front lip 214. The contact 930 in location 8 may be made from berrilium-copper which is more resilient than phosphor-bronze contacts. Certain plugs lack contacts at locations 1 and 8 and tend to apply excessive force on contacts 1 and 8 in outlet 900. Making contact 930 in location 8 from berrilium-copper prevents deformation of the contacts in location 1 when such plugs are used.

Figure 53:
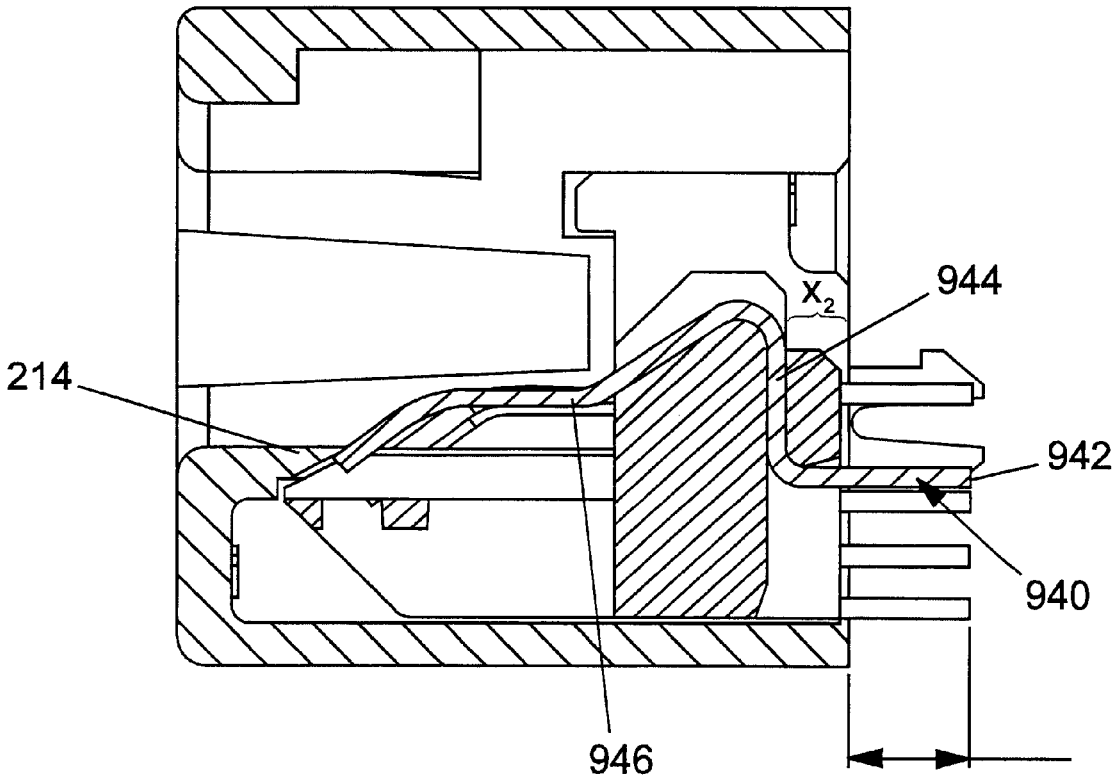
FIG. 53 is a cross sectional view taken along line 53—53 of FIG. 49.

FIG. 53 is a cross sectional view taken along line 53—53 of FIG. 49 depicting a contact 940. Contact 940 is positioned in location 2 in modular outlet 900. Contact 940 has a termination end 942 that engages a circuit board. From the termination end 942, contact 940 enters the rear of the contact carrier and bends approximately 90 degrees to form leg 944. Leg 944 is positioned a distance xl from a rear edge of the outlet 900. Contact 940 then bends more than 90 degrees to define leg 946 which terminates under a front lip 214.

Figure 54:
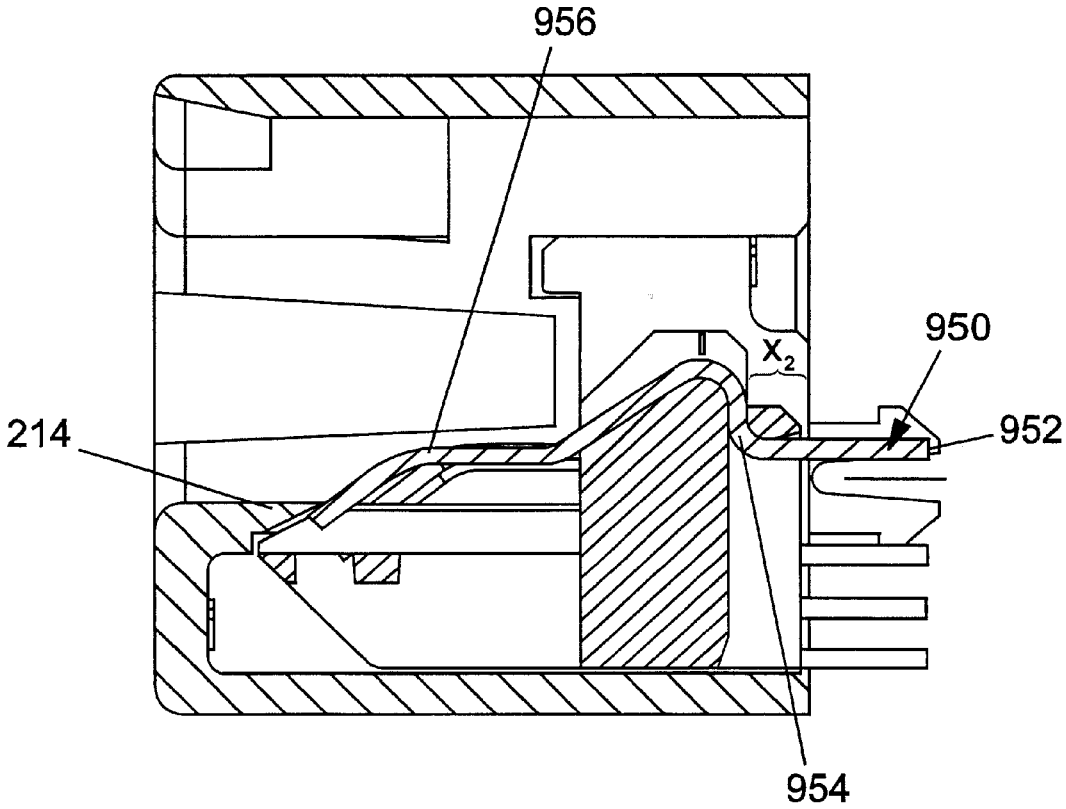
FIG. 54 is a cross sectional view taken along line 54—54 of FIG. 49.

FIG. 54 is a cross sectional view taken along line 54—54 of FIG. 49 depicting a contact 950. Contact 950 is positioned in locations 4 and 6 in modular outlet 900. Contact 950 has a termination end 952 that engages a circuit board. From the termination end 952, contact 950 enters the rear of the contact carrier and bends approximately 90 degrees to form leg 954. Leg 954 is positioned a distance x2 from a rear edge of the outlet 900. Contact 950 then bends more than 90 degrees to define leg 956 which terminates under a front lip 214.

Figure 55:
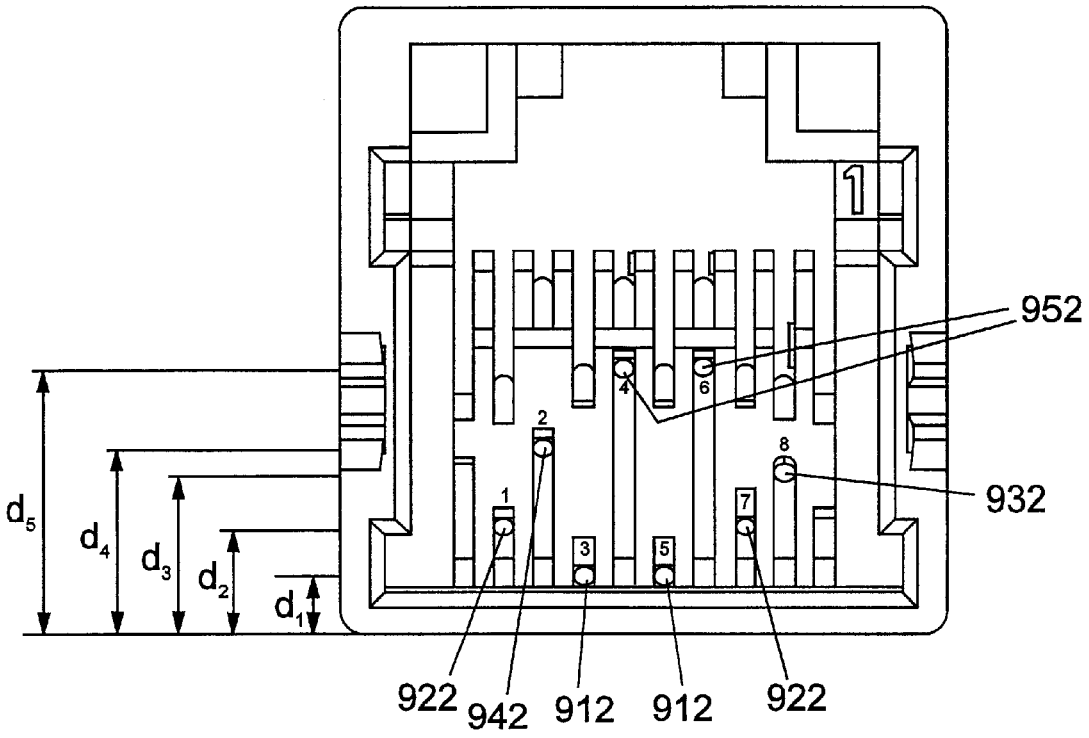
FIG. 55 is a rear view of the outlet of FIG. 49.

Typically, the contacts are arranged in outlet 900 in pairs such that locations 1 and 2 define a pair, locations 3 and 6 define a pair, locations 4 and 5 define a pair and locations 7 and 8 define a pair. FIG. 55 is a rear view of outlet 900 showing the termination ends of the contacts. As shown in FIG. 55, the contact termination ends are located at various distances from an edge of the outlet. Termination ends 912 are located a first distance d1 from an edge of the modular outlet housing. Termination ends 922 are located a second distance d2 from the edge of the modular outlet housing. Termination end 932 is located a third distance d3 from the edge of the modular outlet housing. Termination end 942 is located a fourth distance d4 from the edge of the modular outlet housing. Termination ends 952 are located a fifth distance d5 from the edge of the modular outlet housing. This separation of the contact termination ends reduces crosstalk across pairs and improves performance.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A modular outlet comprising:

a housing having a top, bottom, sides, rear and front, an opening formed in the front for receiving a plug;

said bottom being substantially perpendicular to said opening;

said rear being substantially parallel to said front;

a plurality of contacts positioned in said housing, said contacts having contact termination ends extending beyond said bottom for connection to a printed circuit board;

said plurality of contacts including a first contact entering the bottom and bending approximately 90 degrees to form a first leg, and bending more than 90 degrees but less than 180 degrees at a first knee to define a further first leg;

said plurality of contacts including a second contact entering the bottom and bending approximately 90 degrees to form a second leg, and bending more than 90 degrees but less than 180 degrees at a second knee to define a further second leg;

wherein said first knee is a first distance from said rear of the housing and the second knee is a second distance from said rear of the housing, said first distance being different from said second distance.

2. The outlet of claim 1 wherein:

said contacts are arranged across said outlet in positions 1 through 8, said first contact being in position 1 and said second contact being in position 2.

3. The outlet of claim 2 wherein:

said contact termination ends extending beyond said bottom are arranged in a first row including contact termination ends for positions 1, 3, 5 and 7 and a second row including contact termination ends for positions 2, 4, 6 and 8.

4. The outlet of claim 2 wherein:

said contact in position 1 and said contact in position 2 form a pair.

5. The outlet of claim 3 wherein:

said contact in position 3 and said contact in position 6 form a pair.

6. The outlet of claim 3 wherein:

said contact in position 4 and said contact in position 5 form a pair.

7. The outlet of claim 3 wherein:

said contact in position 7 and said contact in position 8 form a pair.

8. A modular outlet comprising:

a housing having an opening for receiving a plug;

said housing having a rear substantially parallel to said opening;

a plurality of contacts positioned in said housing, said contacts having contact termination ends extending beyond said rear for connection to a printed circuit board;

said contacts being arranged in pairs, a first pair having a first contact and second contact, a second pair having a third contact and a fourth contact and a third pair having a fifth contact and a sixth contact, said first and third contacts having contact termination ends positioned a first distance from an edge of the outlet, said second and fourth contacts having contact termination ends positioned a second distance from the edge of the outlet and said fifth contact having a contact termination end positioned a third distance from the edge of the outlet;

said first distance, said second distance and said third distance being different.

9. The outlet of claim 8 wherein:

said sixth contact has a contact termination end positioned a fourth distance from said edge of the outlet;

said first distance, said second distance, said third distance and said fourth distance being different.

10. The outlet of claim 9 further comprising:

a fourth pair having a seventh and eighth contact, said seventh contact having a contact termination end positioned a fifth distance from said edge of the outlet;

said first distance, said second distance, said third distance, said fourth distance and said fifth distance being different.

11. The outlet of claim 10 wherein:

said eighth contact having a contact termination end positioned at said third distance from said edge of the outlet.

12. A modular outlet comprising:

a housing having an opening for receiving a plug;

said housing having a rear substantially parallel to said opening;

a plurality of contacts positioned in said housing, said contacts having contact termination ends extending beyond said rear for connection to a printed circuit board;

said contacts being arranged in pairs, a first pair having a first contact and second contact, a second pair having a third contact and a fourth contact, a third pair having a fifth contact and a sixth contact, and a fourth pair having a seventh and eighth contact, said first and third contacts having contact termination ends positioned a first distance from an edge of the outlet, said second and fourth contacts having contact termination ends positioned a second distance from the edge of the outlet, and said fifth and eighth contacts having a contact termination end positioned a third distance from the edge of the outlet, said sixth contact having a contact termination end positioned a fourth distance from the edge of the outlet and said seventh contact having a contact termination end positioned a fifth distance from the edge of the outlet;

said first distance, said second distance, said third distance, said fourth distance and said fifth distance being different.

13. A modular outlet comprising:

a housing having an opening for receiving a plug;

a plurality of contacts positioned in said housing, said contacts having contact termination ends extending beyond said housing for connection to a printed circuit board;

said contacts being arranged in pairs, a first pair having a first contact and second contact, a second pair having a third contact and a fourth contact and a third pair having a fifth contact and a sixth contact, said first and third contacts having contact termination ends positioned a first distance from an edge of the outlet, said second and fourth contacts having contact termination ends positioned a second distance from the edge of the outlet and said fifth contact having a contact termination end positioned a third distance from the edge of the outlet;

said first distance, said second distance and said third distance being different.

* * * * *